US010320082B2

(12) United States Patent
Hollister et al.

(10) Patent No.: US 10,320,082 B2
(45) Date of Patent: Jun. 11, 2019

(54) HIGH DIRECTIVITY SLOT ANTENNA

(71) Applicants: AT&T Mobility II LLC, Atlanta, GA (US); AT&T Intellectual Property I, L.P., Atlanta, GA (US)

(72) Inventors: James Hollister, Camarillo, CA (US); James Gordon Beattie, Jr., Bergenfield, NJ (US)

(73) Assignees: AT&T MOBILITY II LLC, Atlanta, GA (US); AT&T INTELLECTUAL PROPERTY I, L.P., Atlanta, GA (US)

( * ) Notice: Subject to any disclaimer, the term of this patent is extended or adjusted under 35 U.S.C. 154(b) by 171 days.

(21) Appl. No.: 15/223,582

(22) Filed: Jul. 29, 2016

(65) Prior Publication Data

US 2018/0034158 A1 Feb. 1, 2018

(51) Int. Cl.
*H01Q 1/38* (2006.01)
*H01Q 13/10* (2006.01)
(Continued)

(52) U.S. Cl.
CPC ..... *H01Q 13/106* (2013.01); *H01Q 9/285* (2013.01); *H01Q 9/32* (2013.01); *H01Q 13/10* (2013.01); *H01Q 13/18* (2013.01); *H01Q 21/08* (2013.01)

(58) Field of Classification Search
CPC ..... H01Q 13/106; H01Q 9/32; H01Q 13/10; H01Q 9/285; H01Q 1/38
(Continued)

(56) References Cited

U.S. PATENT DOCUMENTS 2,469,419 A 5/1949 Tawney
2,767,396 A 10/1956 Cutler
(Continued)

FOREIGN PATENT DOCUMENTS

AU 688212 B2 3/1998
AU 3505701 A 10/2001
(Continued)

OTHER PUBLICATIONS

Baker et al., "Rand", 1995, 19 pages. Retrieved on Sep. 27, 2016. http://aether.lbl.gov/www/projects/neutrino/rand/rand.html.
(Continued)

*Primary Examiner* — Huedung X Mancuso
(74) *Attorney, Agent, or Firm* — Amin, Turocy & Watson, LLP

(57) ABSTRACT

A high directivity slot antenna is presented herein. A method can include receiving, through an aperture of an antenna, a first electromagnetic signal away from a direct path from a source of the first electromagnetic signal to an electrical element of the antenna—the aperture corresponding to a first opening of a central chamber included between portions of radio frequency absorbent material, and the electrical element corresponding to a second opening of the central chamber. Further, the method can include absorbing the first electromagnetic signal into a first portion of the portions of radio frequency absorbent material—the first portion comprising a baffle that is adjacent to a first segment of the radio frequency absorbent material, and the baffle comprising a metallic element that alters a radio frequency propagation of the first electromagnetic signal from the central chamber into the radio frequency absorbent material.

20 Claims, 27 Drawing Sheets

(51) Int. Cl.
*H01Q 9/28* (2006.01)
*H01Q 9/32* (2006.01)
*H01Q 13/18* (2006.01)
*H01Q 21/08* (2006.01)

(58) Field of Classification Search
USPC ..... 343/700 MS
See application file for complete search history.

(56) References Cited

U.S. PATENT DOCUMENTS 3,212,095 A * 10/1965 Ajioka ..... H01Q 19/138 343/780
3,235,869 A 2/1966 Atta
3,599,216 A 8/1971 Paine et al.
4,499,474 A * 2/1985 Muhs, Jr. ..... H01Q 1/521 343/771
4,819,003 A 4/1989 Goto et al.
4,876,554 A 10/1989 Tubbs
4,878,061 A * 10/1989 Nusair ..... H01Q 13/0275 343/786
5,173,714 A 12/1992 Arimura et al.
5,541,612 A 7/1996 Josefsson
5,714,964 A * 2/1998 Jackson ..... H01Q 13/02 343/786
6,856,295 B2 2/2005 Desargant et al.
6,859,187 B2 * 2/2005 Ohlsson ..... G01F 23/284 343/772
6,867,743 B2 3/2005 Schadler
7,161,537 B2 1/2007 Rafi et al.
7,193,575 B2 3/2007 Mohammadian
7,379,030 B1 * 5/2008 Lier ..... H01Q 13/00 343/772
8,229,605 B2 7/2012 Vlad
8,362,948 B2 1/2013 Kolinko et al.
8,421,697 B2 4/2013 Yano
8,504,135 B2 8/2013 Bourqui et al.
8,902,114 B1 12/2014 West et al.
2003/0167839 A1 * 9/2003 Burger ..... G01F 23/284 73/290 V
2007/0152898 A1 * 7/2007 Mizuno ..... H01Q 1/18 343/767
2009/0213022 A1 * 8/2009 Lier ..... H01P 3/12 343/785
2010/0220024 A1 * 9/2010 Snow ..... H01Q 9/28 343/772
2011/0105019 A1 * 5/2011 Tavassoli Hozouri .... H01P 5/08 455/39
2013/0307522 A1 * 11/2013 Nakase ..... H01Q 9/30 324/76.11
2014/0043195 A1 2/2014 Ho et al.
2014/0128032 A1 5/2014 Muthukumar

FOREIGN PATENT DOCUMENTS

WO 2005062943 A2 7/2005
WO 2016027007 A1 2/2016

OTHER PUBLICATIONS

Sievenpiper et al.,"Low-profile cavity-backed crossed-slot antenna with a single-probe feed designed for 2.34-GHz satellite radio applications", IEEE Transactions on Antennas and Propagation, Mar. 2004, vol. 52, Issue No. 3, pp. 873-879, IEEE.
Yi et al, "How is the capacity of ad hoc networks improved with directional antennas?", 2006, pp. 635-648, Springer Science + Business Media, LLC.

* cited by examiner

600

1700

HIGH DIRECTIVITY SLOT ANTENNA

TECHNICAL FIELD

The subject disclosure generally relates to high directivity slot antennae.

BACKGROUND

Interfering radio frequency (RF) emissions negatively affect wireless network performance, and identifying such emissions has been challenging and costly. Consequently, conventional wireless technologies have had some drawbacks, some of which may be noted with reference to the various embodiments described herein below.

BRIEF DESCRIPTION OF THE DRAWINGS

Non-limiting embodiments of the subject disclosure are described with reference to the following figures, wherein like reference numerals refer to like parts throughout the various views unless otherwise specified.

DETAILED DESCRIPTION

Figure 1:
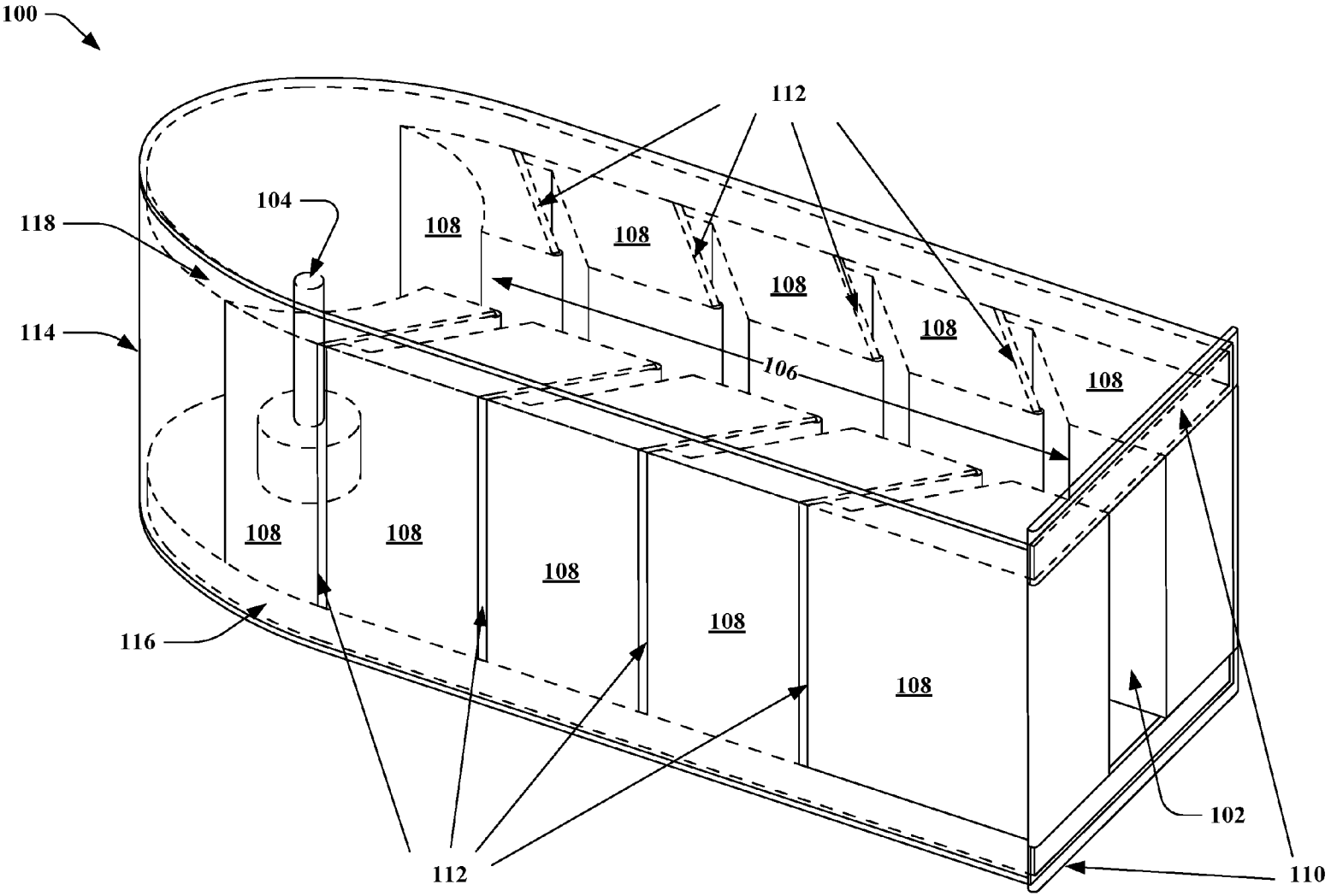
FIG. 1 illustrates a block diagram of a slot antenna with side chambers, in accordance with various example embodiments.

Aspects of the subject disclosure will now be described more fully hereinafter with reference to the accompanying drawings in which example embodiments are shown. In the following description, for purposes of explanation, numerous specific details are set forth in order to provide a thorough understanding of the various embodiments. However, the subject disclosure may be embodied in many different forms and should not be construed as limited to the example embodiments set forth herein.

As described above, conventional wireless technologies have had some drawbacks with respect to identifying interfering RF sources that negatively impact wireless network performance. Further, such technologies have had some drawbacks with respect to providing wireless service in narrow coverage areas without causing interference to adjacent sectors of wireless cell site(s), e.g., corresponding to streets, stadiums, arena concourses, hallways, jetways, rail platforms, etc. Various embodiments disclosed herein can enable RF engineers to locate, identify, etc. interfering RF sources and/or improve wireless service in narrow coverage areas without causing interference to adjacent sectors of a wireless cell site by providing an antenna with a narrow RF transmission/reception pattern.

For example, a method can comprise: receiving, through an aperture of an antenna, e.g., slot antenna, an electromagnetic signal away from a direct path from a source of the electromagnetic signal to an electrical element, e.g., receiver, transceiver, monopole, dipole, etc. of the antenna—the aperture corresponding to a first opening of a central chamber included between portions of RF absorbent material, e.g., foam, and the electrical element corresponding to a second opening of the central chamber.

Further, the method can include absorbing the electromagnetic signal into a first portion of the portions of RF absorbent material—the first portion comprising a baffle that is adjacent to a first segment of the RF absorbent material, and the baffle comprising a metallic element, e.g., conductor, that alters an RF propagation of the electromagnetic signal from the central chamber into the RF absorbent material.

In another embodiment, the antenna can comprise side chambers between segments of the RF absorbent material, and the absorbing of the electromagnetic signal can comprise reflecting, via one of the side chambers located between the first segment of the RF absorbent material and a second segment of the RF absorbent material, the electromagnetic signal from the baffle to the second segment, and absorbing the electromagnetic signal into the second segment of the RF absorbent material.

In yet another embodiment, the method can further comprise receiving, through the aperture, an electromagnetic signal away from the direct path from the source to the electrical element; and absorbing the electromagnetic signal into the first segment, e.g., the electromagnetic signal not being reflected by a baffle.

In one embodiment, the method can further comprise receiving, through the aperture, an electromagnetic signal away from the direct path from the source to the electrical element; and absorbing the electromagnetic signal into the second segment, e.g., the electromagnetic signal not being reflected by a baffle.

In an embodiment, the method can further comprise receiving, through the aperture along the direct path from the source to the electrical element, e.g., a transceiver, an electromagnetic signal at the electrical element, e.g., for locating, identifying, pinpointing, etc. an RF source.

In another embodiment, the method can further comprise transmitting, through the aperture from the electrical element, another electromagnetic signal along the direct path, e.g., for providing a narrow RF transmission pattern, e.g., without causing interference to adjacent wireless cell cite sector(s), e.g., corresponding to a street, a stadium, an arena concourse, a hallway, a jet way, a train platform, etc. In one embodiment, the electrical element can comprise a set of elements, e.g., comprising monopole element(s), dipole element(s), etc.

Another embodiment can comprise an antenna, e.g., slot antenna, comprising: an electrical element, e.g., receiver, transmitter, transceiver, etc. comprising a monopole, a dipole, a set of dipoles, etc. The antenna further comprises an aperture; a center channel comprising a front portion corresponding to the aperture and a back portion corresponding to the electrical element; and columns of RF absorbent material adjacent to respective sides of the center channel. In this regard, a column of the columns comprises baffles adjacent to respective sections of the RF absorbent material, and a baffle of the baffles comprises a metallic element, e.g., conductor, that alters an RF propagation of a radio wave from the center channel into a section of the respective sections that absorbs the radio wave—the radio wave received through the aperture and misaligned from a direct path between a source of the radio wave and the electrical element.

In an embodiment, the baffle is adjacent to a first section of the respective sections, and reflects the radio wave to a second section of the respective sections—the second section absorbing the radio wave.

In another embodiment, a radio wave that has been received through the aperture and misaligned from the direct path between the source and the electrical element, e.g., without being reflected by a baffle, can be absorbed by, within, etc. the first section.

In yet another embodiment, the radio wave that has been received through the aperture and misaligned from the direct path between the source and the electrical element, e.g., without being reflected by the baffle, can be absorbed by, within, etc. the second section.

In one embodiment, the radio wave that has been received through the aperture and misaligned from the direct path between the source and the electrical element, e.g., without being reflected by the baffle, can be absorbed by, within, etc. a third section of the sections.

In another embodiment, the electrical element receives, through the aperture along the direct path between the source and the electrical element, a radio wave.

In yet another embodiment, the electrical element transmits a radio wave through the aperture along the direct path.

In an embodiment, a size of an opening of the aperture is configurable.

In one embodiment a system comprises: a processor; and a memory that stores executable instructions that, when executed by the processor, facilitate performance of operations, comprising: receiving, via a central chamber between columns of segments of an antenna, a first electromagnetic signal away from a direct path from a source of the first electromagnetic signal to an electrical element of the antenna—the segments being adjacent to respective baffles and comprising a radio frequency absorbent material, and the first electromagnetic signal being absorbed in a segment of the segments.

In one embodiment, a column of the columns comprises a side chamber between a pair of the segments, and a baffle of the respective baffles is adjacent to a first segment of the pair of segments. Further, the first electromagnetic signal can be reflected from the baffle to a second segment of the pair of segment, and the second segment can absorb the first electromagnetic signal.

In another embodiment, an aperture size of the aperture, a size of the electrical element, a position of the electrical element, an angle of the baffle, and/or a length of the baffle is configurable to optimize a reception characteristic of the antenna and/or a transmission characteristic of the antenna. Further, the operations further comprise: receiving, via the central chamber, a second electromagnetic signal along the direct path from the source to the electrical element; and determining, via the electrical element based on the reception characteristic, an electrical characteristic of the second electromagnetic signal.

Reference throughout this specification to "one embodiment," or "an embodiment," means that a particular feature, structure, or characteristic described in connection with the embodiment is included in at least one embodiment. Thus, the appearances of the phrase "in one embodiment," or "in an embodiment," in various places throughout this specification are not necessarily all referring to the same embodiment. Furthermore, the particular features, structures, or characteristics may be combined in any suitable manner in one or more embodiments.

As described above, conventional wireless technologies have had difficulties with respect to identifying interfering RF sources and/or improving wireless service within narrow wireless coverage areas. Various embodiments described herein enable locating RF emissions that can negatively affect wireless network performance, and improving wireless service in wireless coverage areas that are linear in nature, e.g., on streets, stadium concourses, hallways, jetways, train platforms, etc. by utilizing a high directivity slot antenna.

Figure 2:
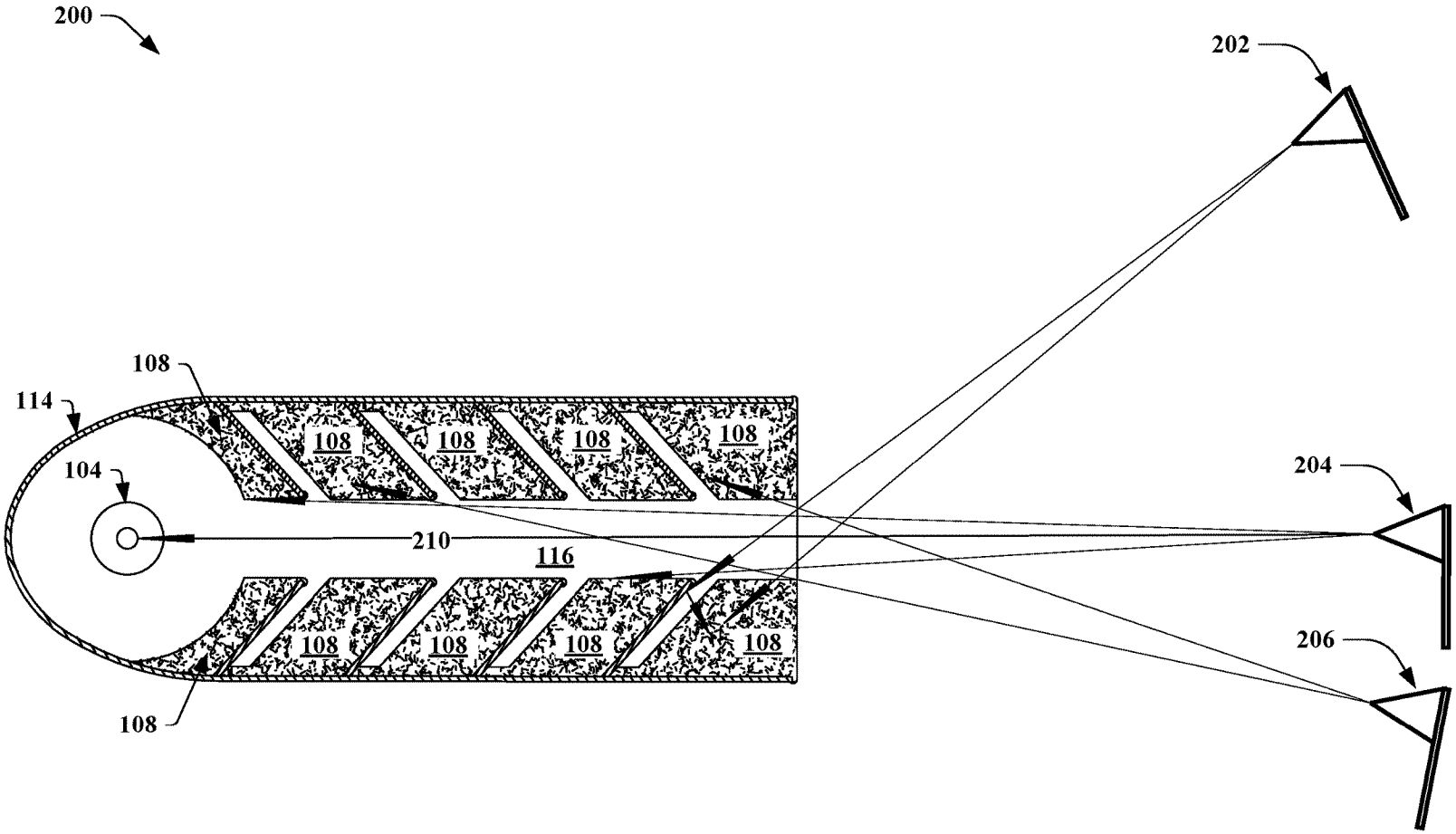
FIG. 2 illustrates a block diagram of electromagnetic signals being received within an aperture of a slot antenna, in accordance with various example embodiments.

Referring now to FIGS. 1 and 2, block diagrams of a slot antenna (100) with side chambers, and sources (202, 204, 206) directing electromagnetic signals towards slot antenna 100, are illustrated, respectively, in accordance with various example embodiments. Slot antenna 100 comprises electrical element 104, e.g., a monopole, that can be configured to receive an electromagnetic signal through center channel 106 and aperture 102, e.g., along a direct, e.g., narrow, path (200) between a source (202, 204, 206) of the electromagnetic signal and electrical element 104.

Further, slot antenna 100 comprises columns of RF absorbent material adjacent to respective sides of center channel 106. The columns of RF absorbent material comprise baffles (112), e.g., coated with and/or made of a metallic element, conductor, etc. that are adjacent to respective sections (108) of the RF absorbent material. In this regard, a baffle of the baffles can alter an RF propagation of an electromagnetic signal, which has been received through aperture 102 and misaligned from direct path 200, from center channel 106 into one of the respective sections (108) of the RF absorbent material, which can then absorb the electromagnetic signal.

As illustrated by FIGS. 1 and 2, in example embodiments, slot antenna 100 can comprise side channels, chambers, etc. between the respective sections 108 of the RF absorbent material, e.g., with baffles 112 comprising respective side walls of the side channels, chambers, etc., and sections 108 of the RF absorbent material comprising opposite side walls of the side channels, chambers, etc. In this regard, in one example embodiment, the baffle can reflect an electromagnetic signal—received through aperture 102 and misaligned from direct path 200—from a side wall of a first channel of the side channels formed by a first section of sections 108 of the RF absorbent material to an opposite side wall of the side channel comprising a second section of sections 108 of the RF absorbent material.

In another example embodiment, another electromagnetic signal that has been received through aperture 102 and misaligned from direct path 200, e.g., without being reflected by a baffle, can be absorbed by, into, etc. the first section of the RF absorbent material.

In yet another example embodiment, another electromagnetic signal that has been received through aperture 102 and misaligned from direct path 200, e.g., without being reflected by a baffle, can be absorbed by, into, etc. the second section of the RF absorbent material.

In one example embodiment, another electromagnetic signal that has been received through aperture 102 and misaligned from direct path 200, e.g., without being reflected by a baffle, can be absorbed by, into, etc. a third section of the RF absorbent material.

Figure 3:
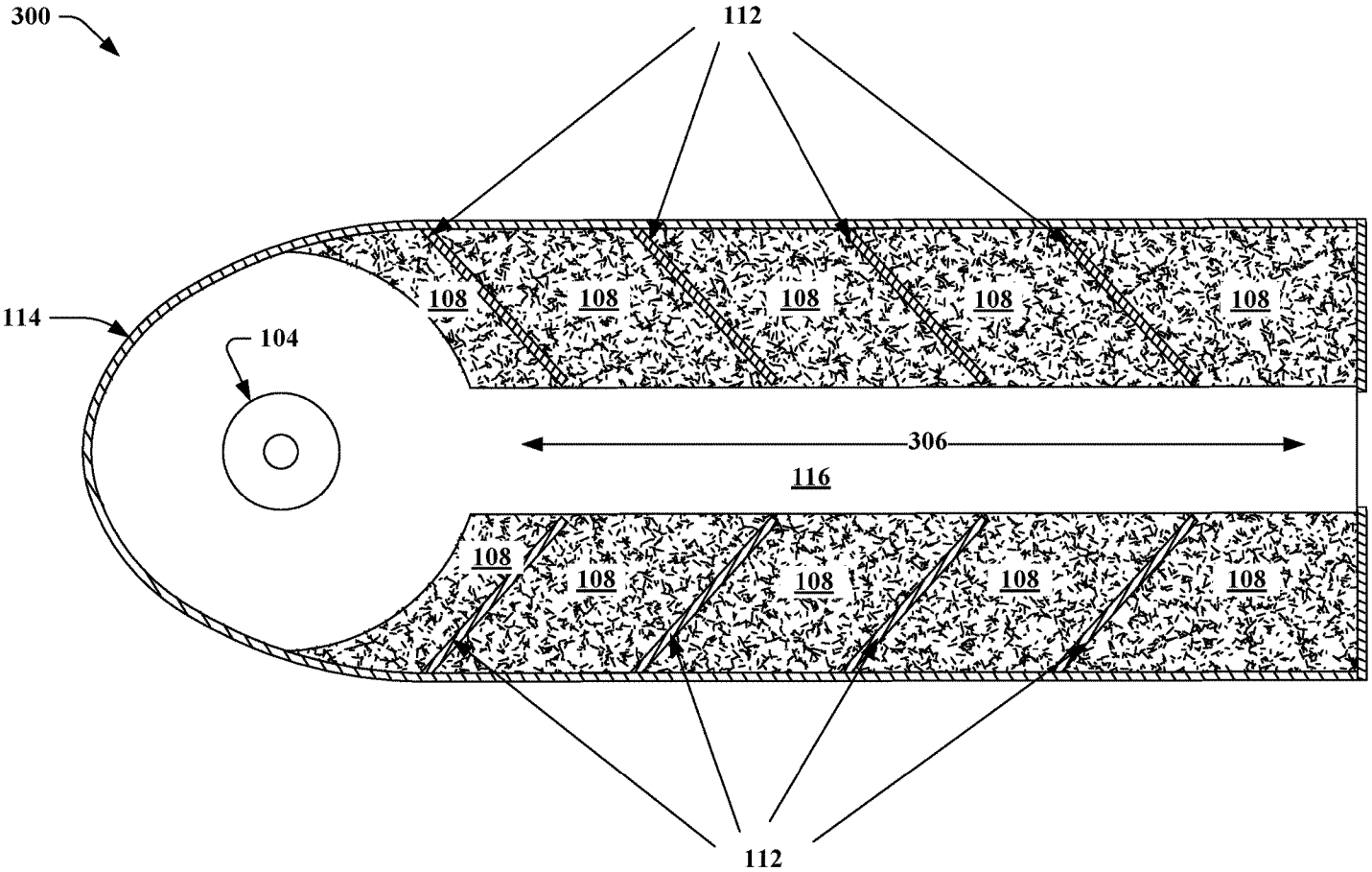
FIG. 3 illustrates a block diagram of a top view of a slot antenna without side chambers, in accordance with various example embodiments.

In another example embodiment illustrated by FIG. 3, slot antenna 100 does not comprise side channels, chambers, etc. between the respective sections 108 of the RF absorbent material. In this regard, baffles 112 are embedded within the respective sections 108 of the RF absorbent material, and electromagnetic signal(s) that have been received through aperture 102 and misaligned from direct path 200 can be absorbed by, into, etc. portions(s) of the respective sections 108 of the RF absorbent material.

In yet another example embodiment, electrical element 104 is configured to transmit a radio wave through aperture 102 along the direct path.

Figure 4:
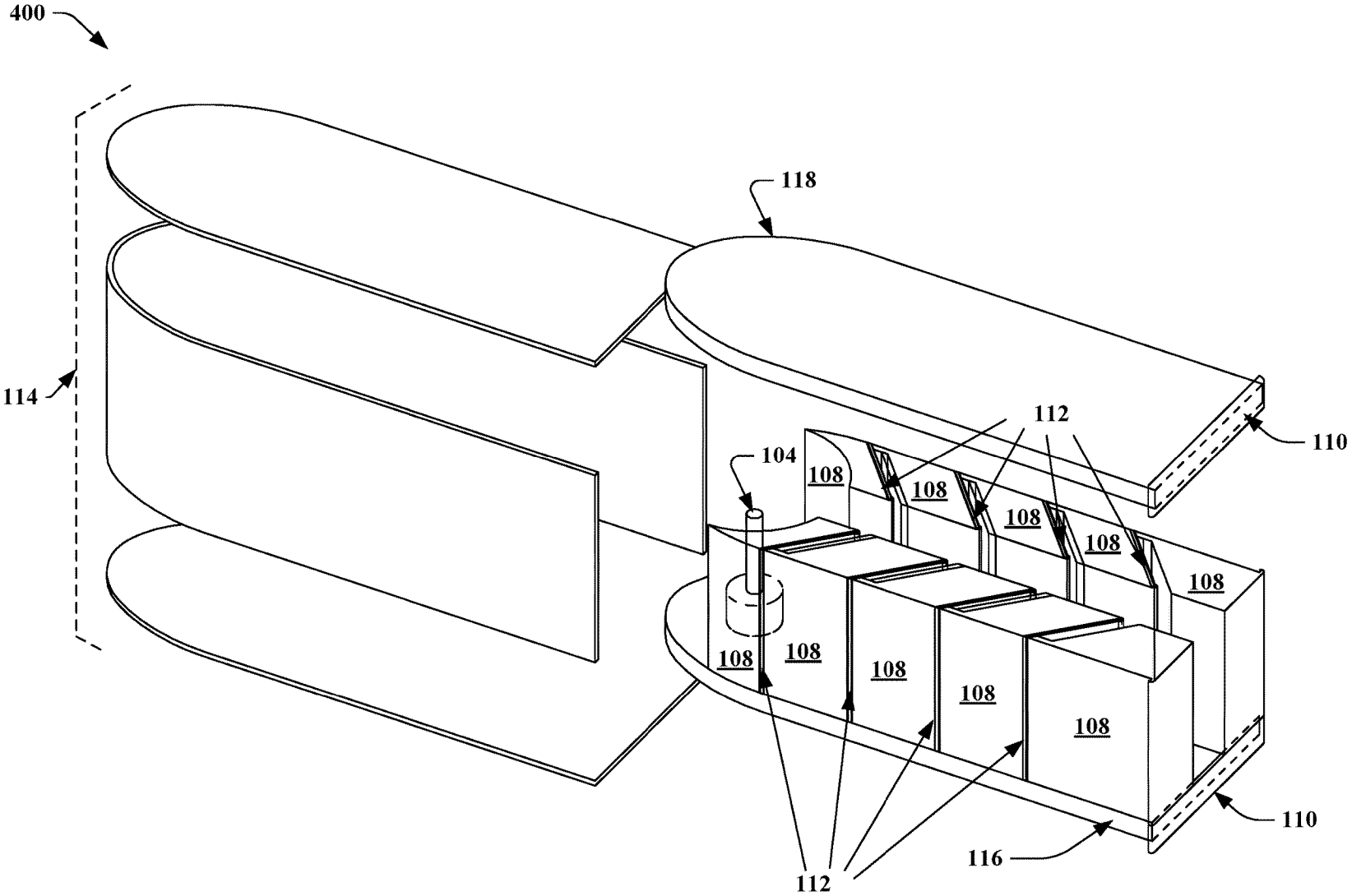
FIG. 4 illustrates a block diagram of an assembly of a slot antenna, in accordance with various example embodiments.

Referring now to FIG. 4, slot antenna 100 can be assembled by placing other RF absorbent material 116 and 118 on top and bottom portions of the columns of RF absorbent material, then side portion(s) of metal surround 114 can be soldered to baffles 112 to encase, form a shell around, etc. the columns of RF absorbent material and the other RF absorbent material 116 and 118. Further, top and bottom portions of metal surround 114 can be soldered to the side portion(s) of metal surround 114 to surround outside portions of slot antenna 100, except for portions of slot antenna 100 corresponding to aperture 102.

In this regard, pieces of RF absorbent material (110) can be placed over front edges of metal surround 114 corresponding to aperture 102. In an example, embodiment, the pieces of RF absorbent material 110 can comprise a foam, etc. of a different composition, RF absorption property, etc. than the RF absorbent material of sections 108.

Figure 5:
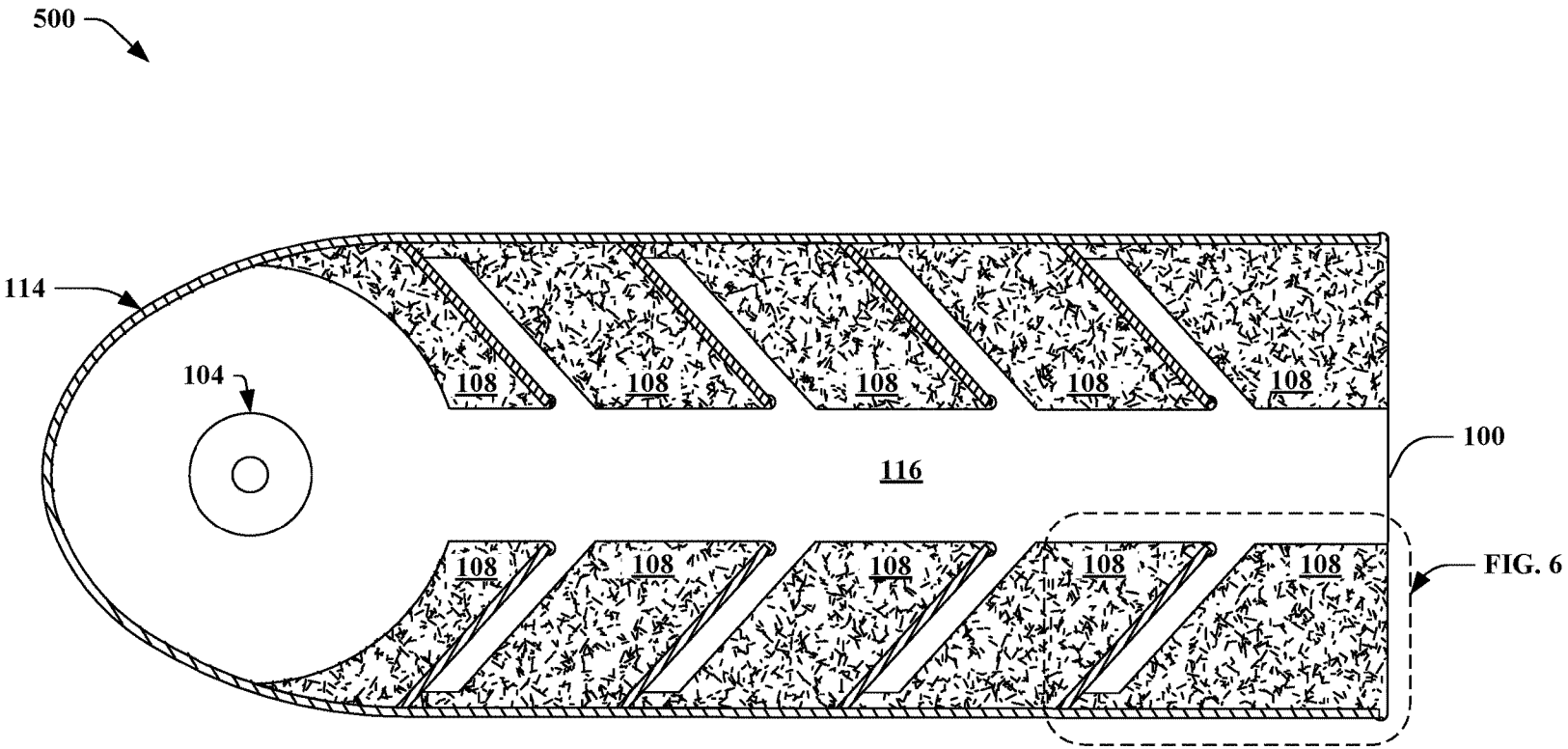
FIG. 5 illustrates a block diagram of a top view of a slot antenna with side chambers, in accordance with various example embodiments.
Figure 6:
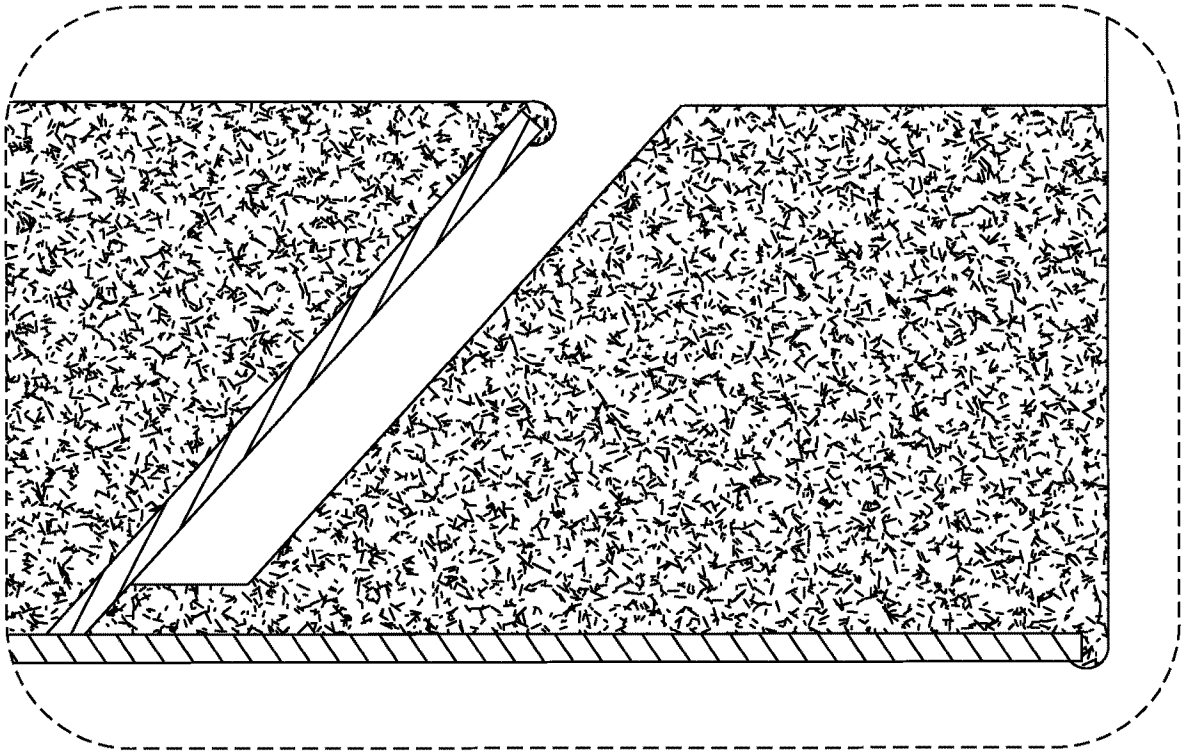
FIG. 6 illustrates a block diagram of a portion of a top view of a slot antenna with side chambers, in accordance with various example embodiments.

In example embodiments illustrated by FIGS. 5 and 6, portions of the columns of RF absorbent material can surround, wrap around, etc. exposed edges of baffles 112, e.g., to reduce knife-edge refraction from baffles 112.

Figure 7:
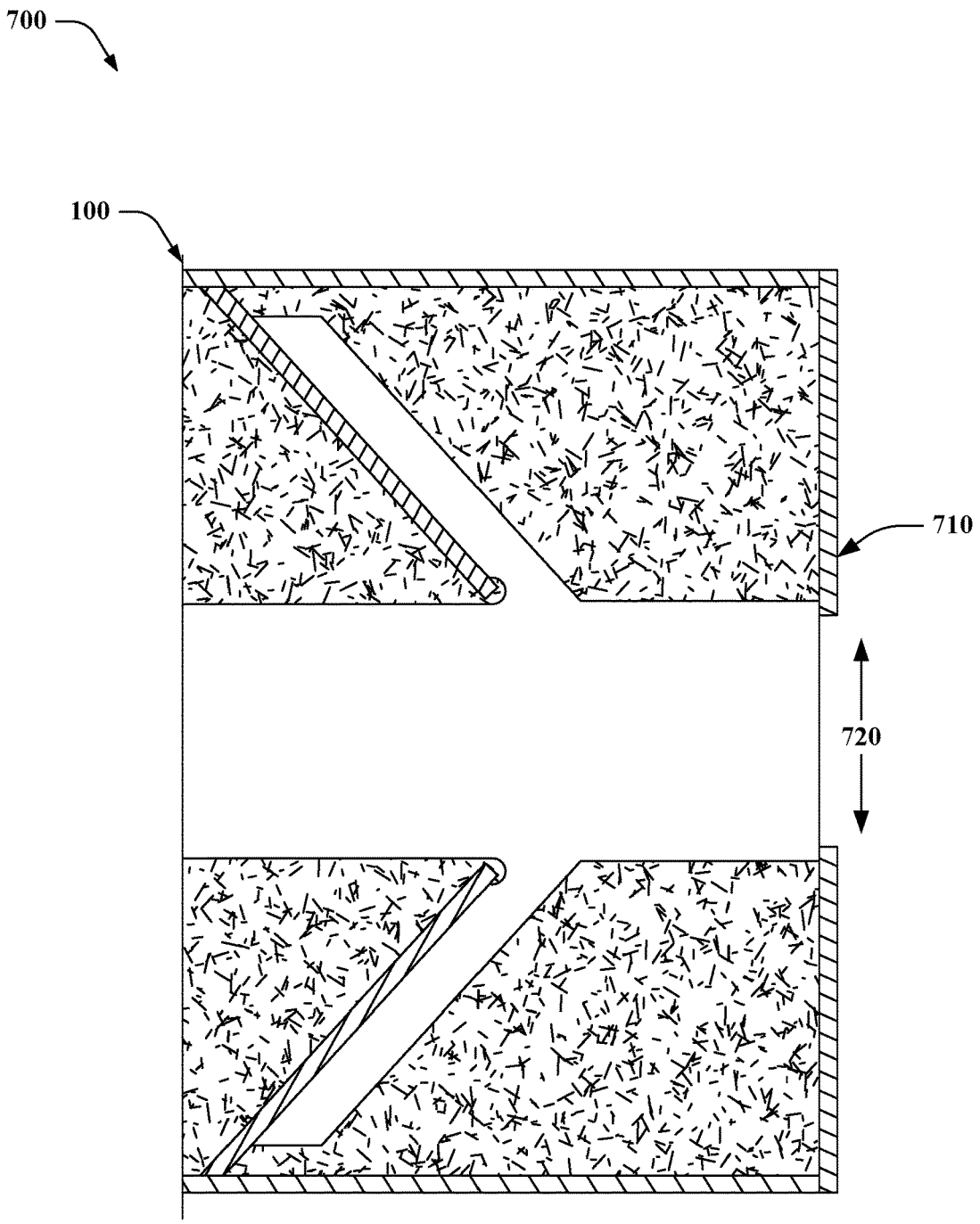
FIG. 7 illustrates a block diagram of an adjustable aperture of a slot antenna, in accordance with various example embodiments.
Figure 8:
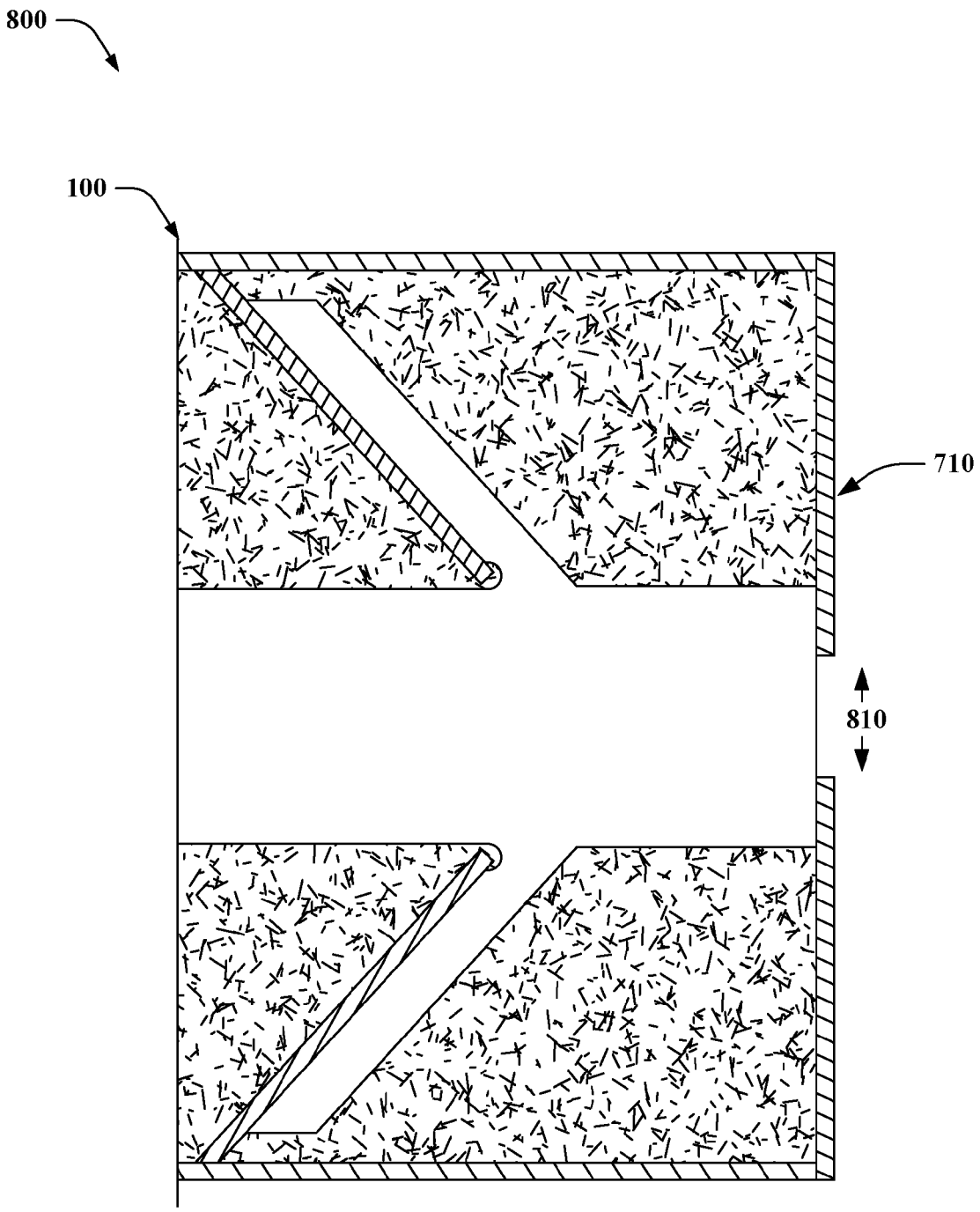
FIG. 8 illustrates another block diagram of an adjustable aperture of a slot antenna, in accordance with various example embodiments.
Figure 9:
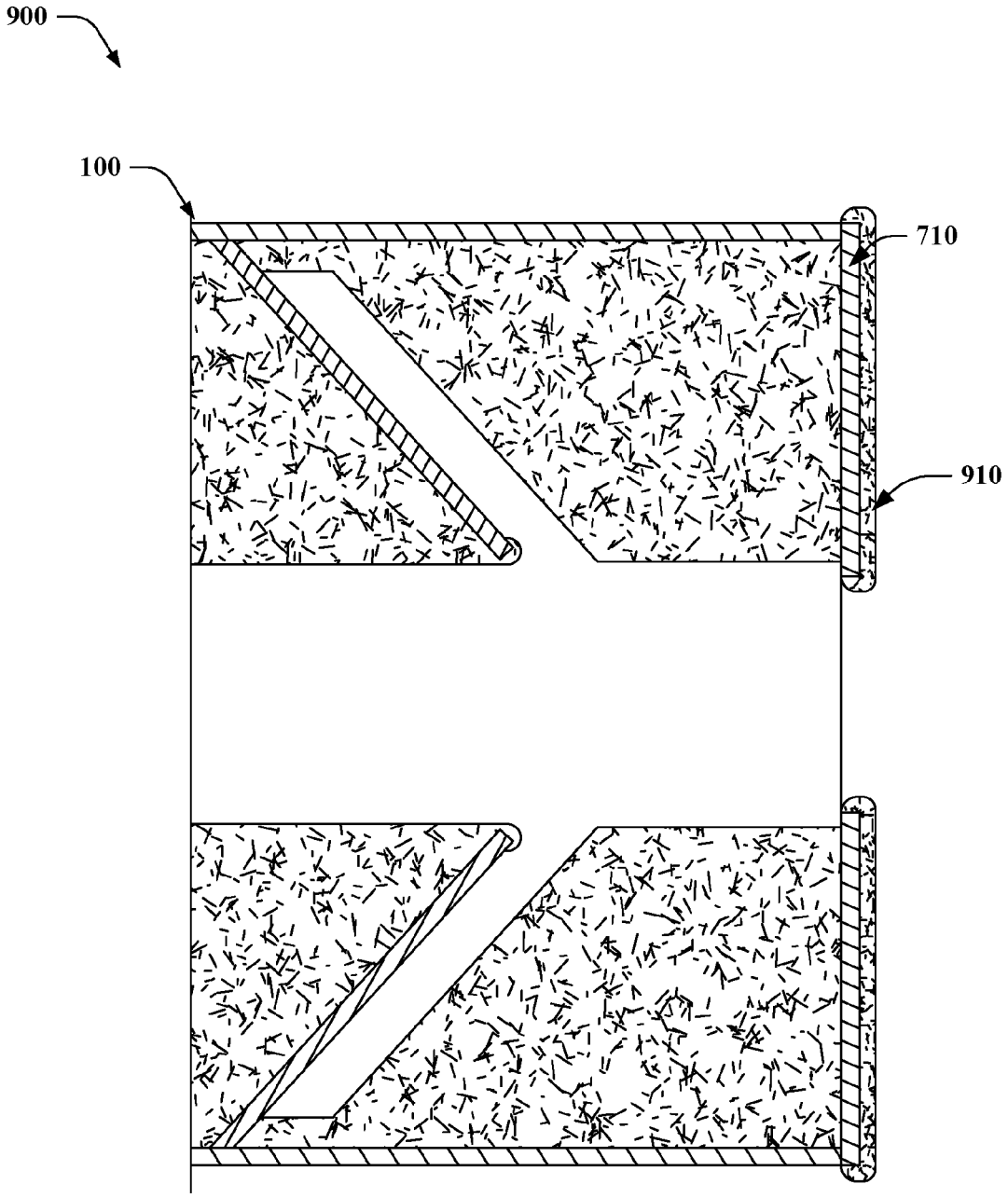
FIG. 9 illustrates a block diagram of an RF absorbent foam attached to an aperture of a slot antenna, in accordance with various example embodiments.

FIGS. 7-8 illustrate block diagrams of slot antenna 100 comprising an adjustable aperture 710, in accordance with various example embodiments. Adjustable aperture 710 can comprise metal portions forming an adjustable opening at one end of slot antenna 100, i.e., opposite another end of slot antenna 100 corresponding to electrical element 104—the adjustable opening enabling adjustment of reception and transmission characteristics of slot antenna 100, modifying a gain of slot antenna 100, etc. In this regard, in embodiments, adjustable aperture 710 can form an opening (720, 810) that is smaller than a gap formed between the columns of RF absorbent material. Further, in an example embodiment illustrated by FIG. 9, edge(s) of adjustable aperture 710 can be covered with RF absorbent material 910 to reduce reflections of electromagnetic signals from adjustable aperture 710.

Figure 10:
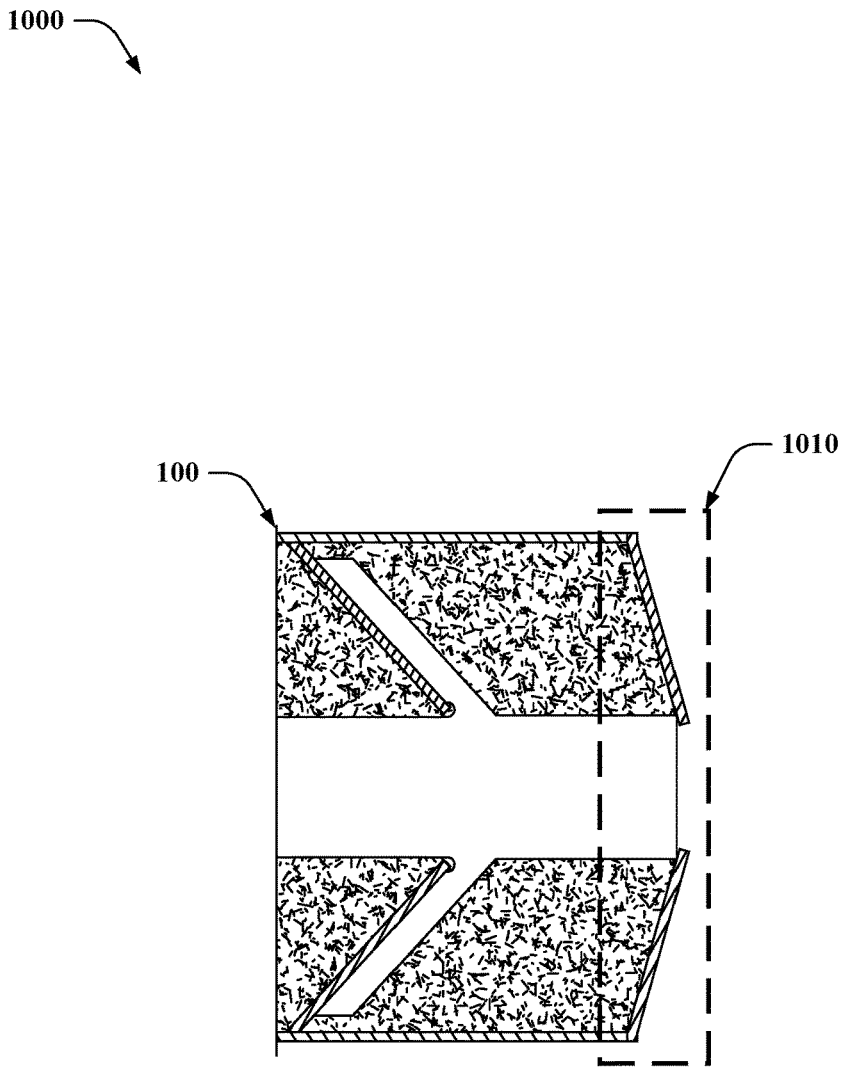
FIG. 10 illustrates a block diagram of an angled configurable aperture, in accordance with various example embodiments.
Figure 11:
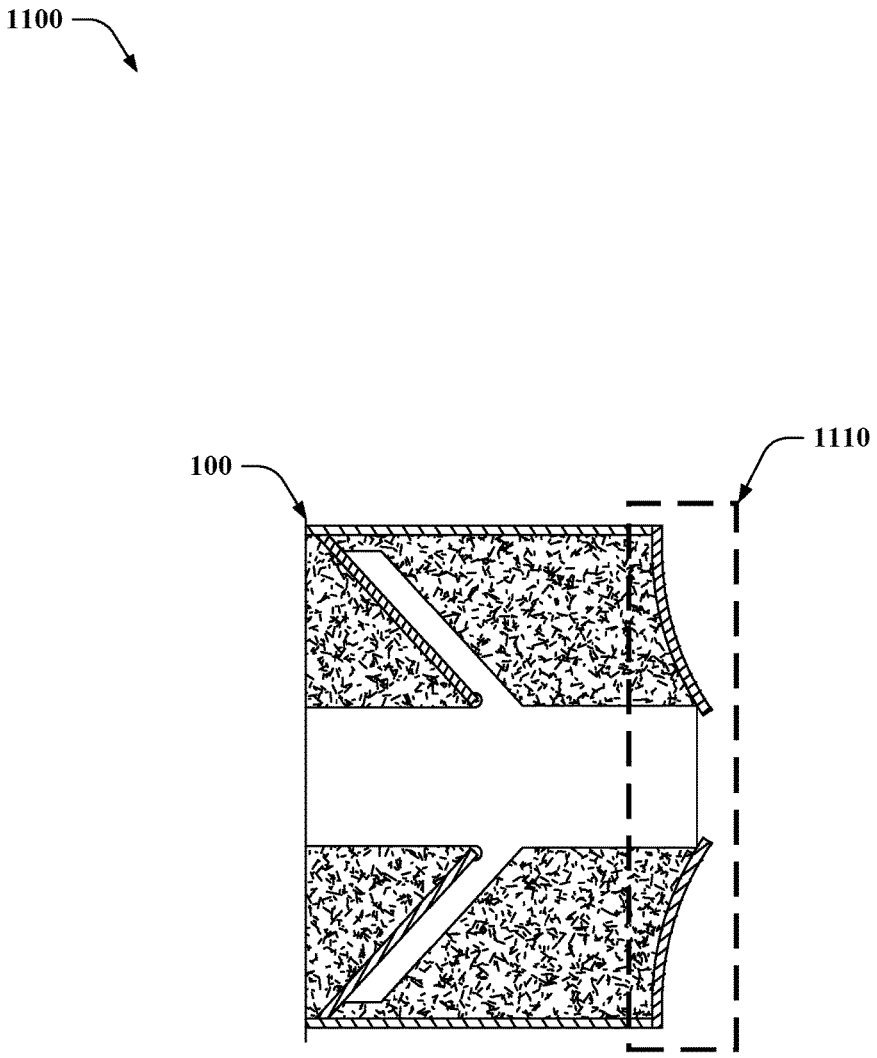
FIG. 11 illustrates a block diagram of a curved configurable aperture, in accordance with various example embodiments.

Now referring to example embodiments illustrated by FIGS. 10-11, slot antenna 100 can comprise a configurable, or mechanically adjustable, aperture (1010, 1110). FIG. 10 illustrates slot antenna 100 comprising an angled configurable aperture 1010. It should be appreciated by a person of ordinary skill in the art of antenna technologies having the benefit of the instant disclosure that although not illustrated by FIG. 10, front facing portions of angled configurable aperture 1010 can be covered with an RF absorbent material, e.g., to reduce reflections, refractions, etc. of electromagnetic signals from angled configurable aperture 1010.

FIG. 11 illustrates slot antenna 100 comprising a curved configurable aperture 1110, in accordance with various example embodiments. It should be appreciated by a person of ordinary skill in the art of antenna technologies having the benefit of the instant disclosure that although not illustrated by FIG. 11, front facing portions of curved configurable aperture 1110 can be covered with an RF absorbent material, e.g., to reduce reflections, refractions, etc. of electromagnetic signals from curved configurable aperture 1110.

Figure 12:
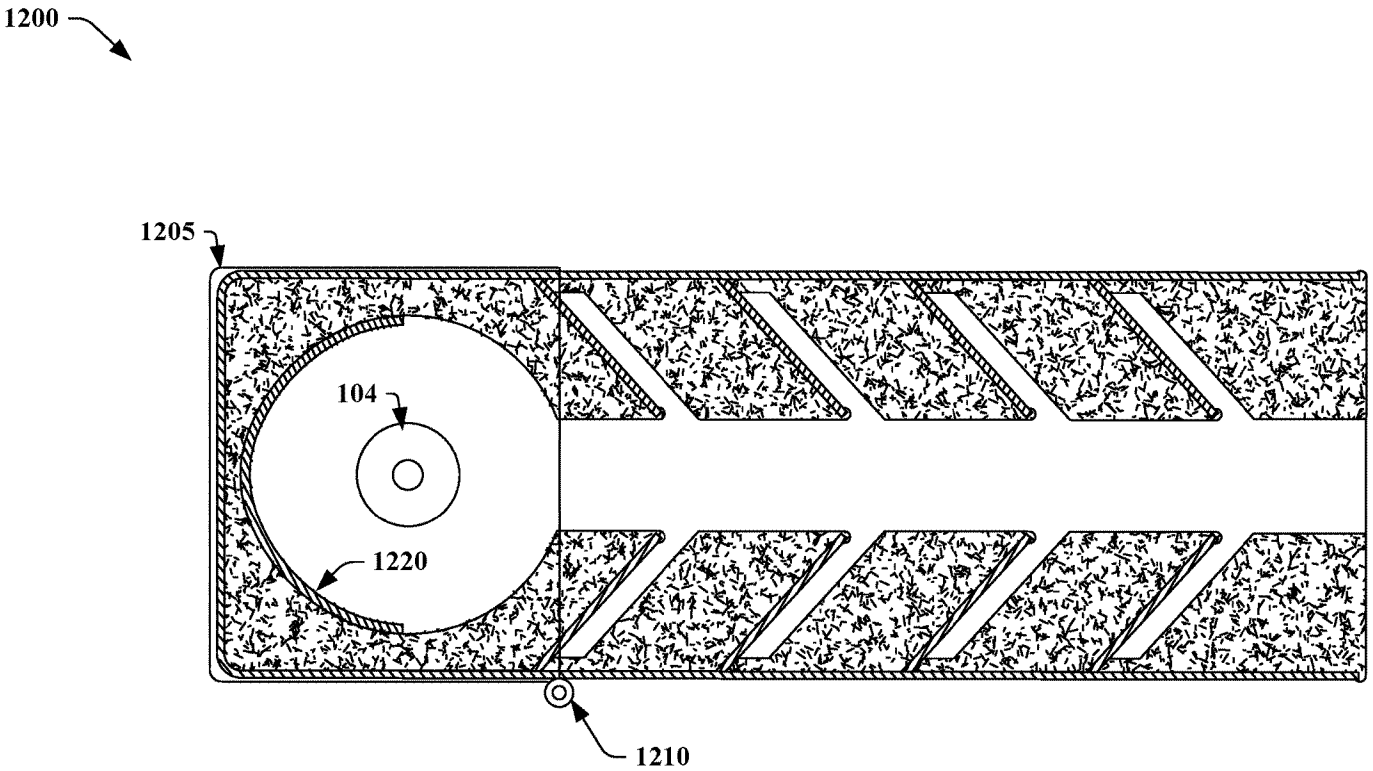
FIG. 12 illustrates a block diagram of a slot antenna with an interchangeable element portion, in accordance with various example embodiments.

FIG. 12 illustrates a block diagram of slot antenna 100 comprising an interchangeable element portion (1205), in accordance with various example embodiments. In this regard, interchangeable element portion 1205 can comprise a particular arrangement of electrical element 104 and reflective section 1220, e.g., comprising a different placement of electrical element 104, different placement of reflective section 1220, a different configuration of electrical element 104, e.g., a monopole configuration, a dipole configuration, etc. of feed element 104, or a set of feed elements comprising feed element 104, etc. than the example embodiment illustrated by FIG. 12. In this regard, hinge 1210 enables mechanical replacement of interchangeable element portion 1205. It should be appreciated by a person of ordinary skill in the art of antenna technologies having the benefit of the instant disclosure that hinge 1210 can alternatively be attached to metal surround 114 across the top of metal surround 114.

Figure 13:
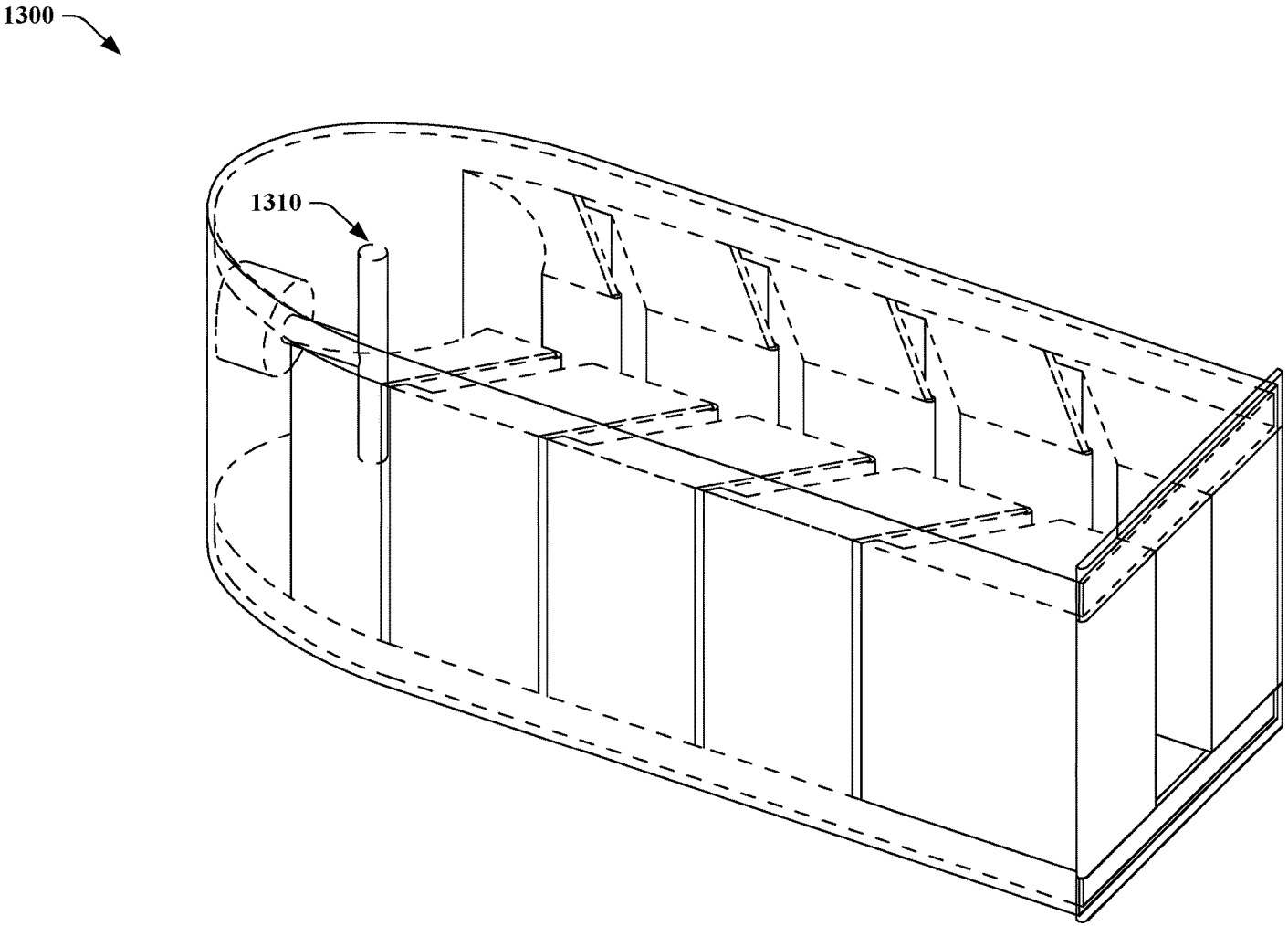
FIG. 13 illustrates a block diagram of a slot antenna comprising a rear-fed single element feed element, in accordance with various example embodiments.
Figure 14:
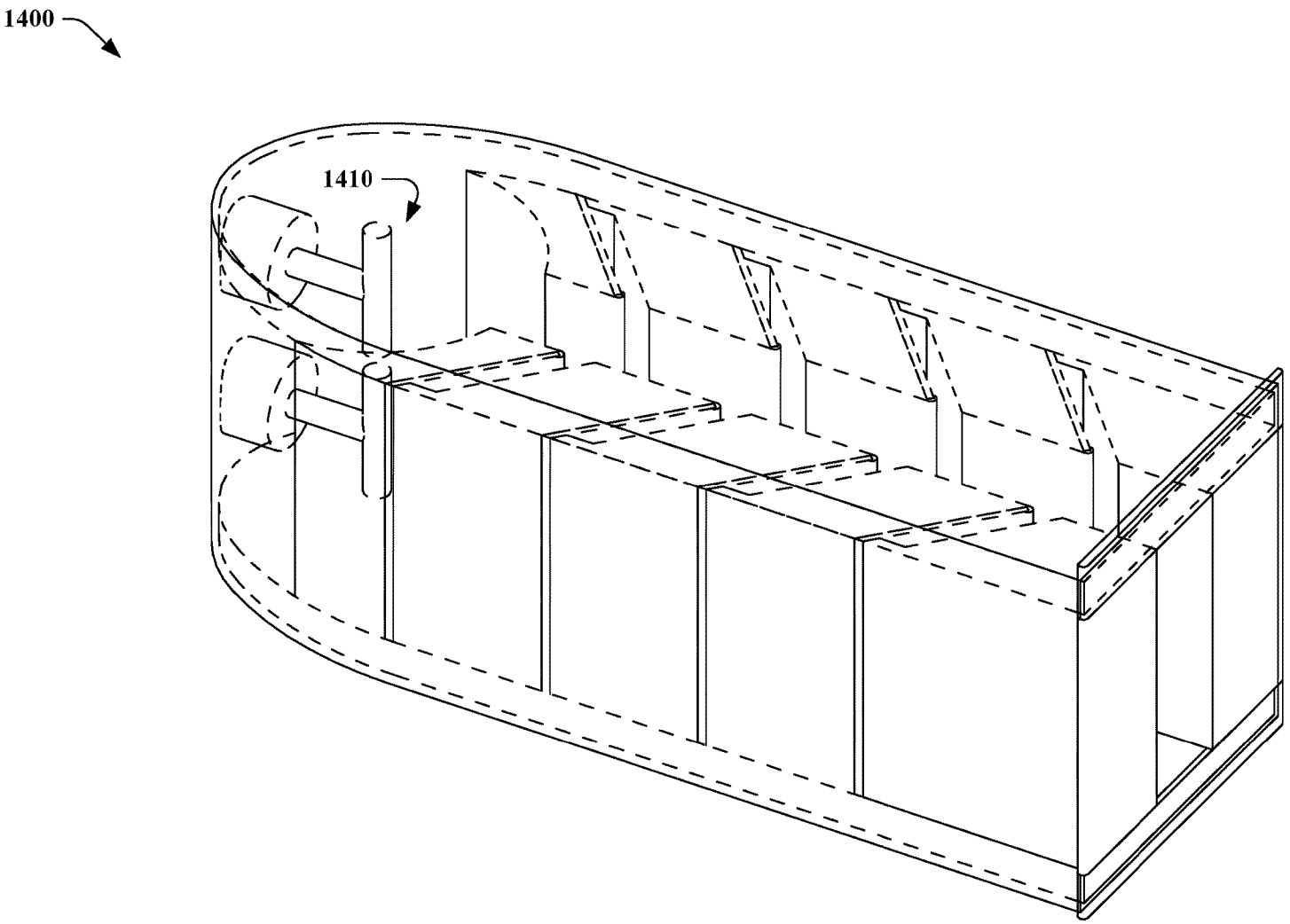
FIG. 14 illustrates a block diagram of a slot antenna comprising a pair of rear-fed multi-element feed elements, in accordance with various example embodiments.
Figure 15:
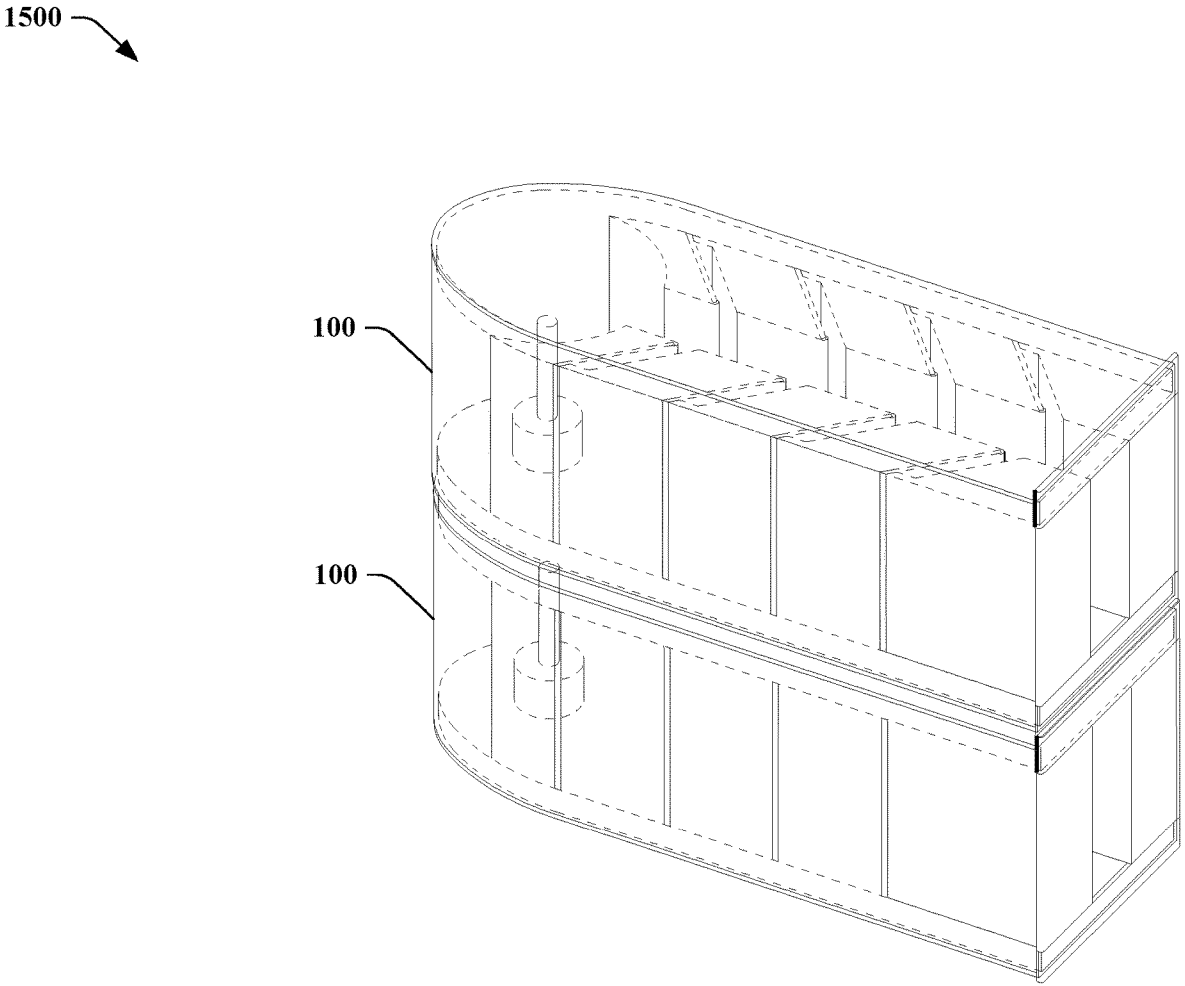
FIG. 15 illustrates a block diagram of a stacked, multi-phase array of slot antennas for increasing signal gain, in accordance with various example embodiments.
Figure 16:
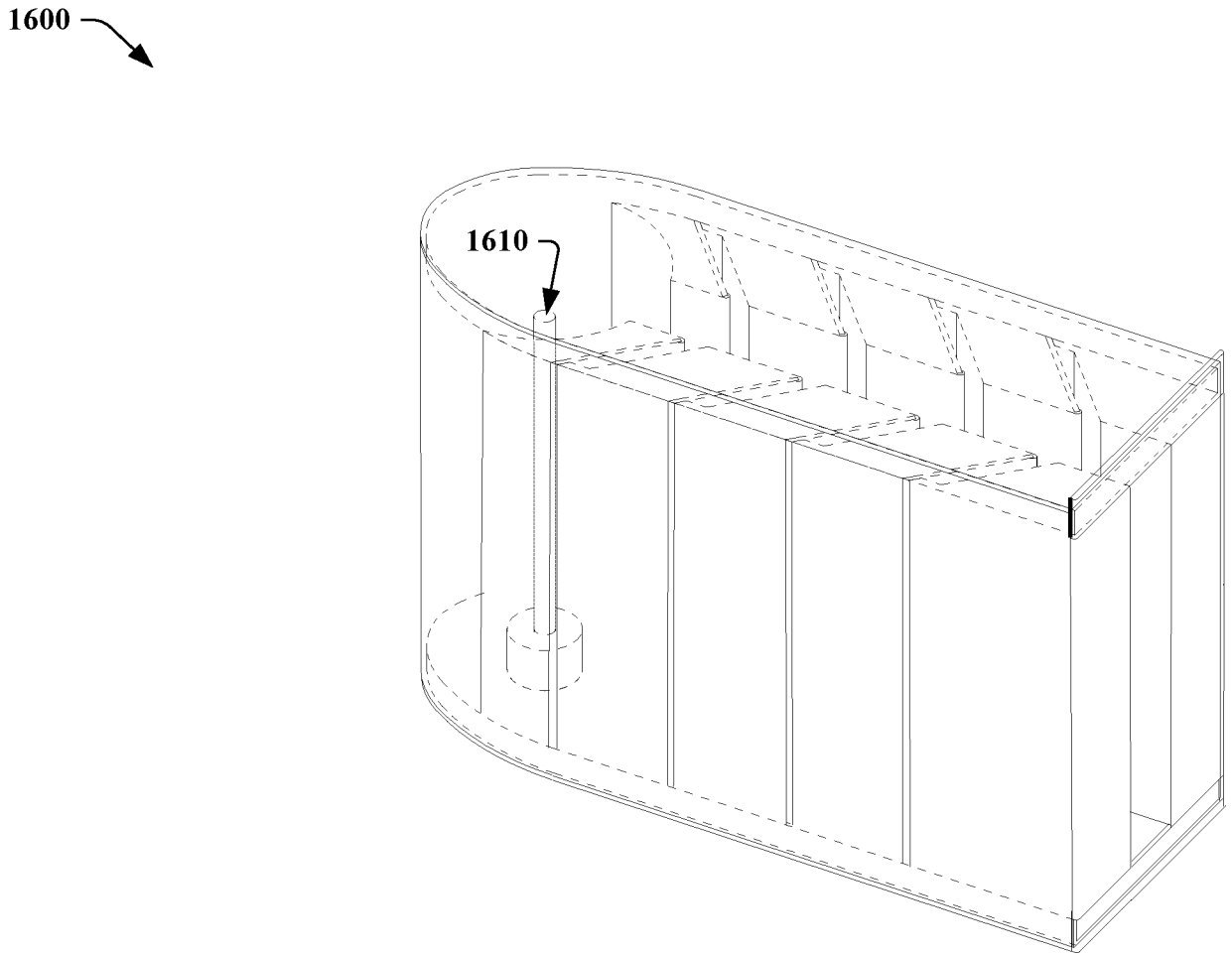
FIG. 16 illustrates a block diagram of a slot antenna for detecting an electromagnetic signal of increased frequency, in accordance with various example embodiments.
Figure 17:
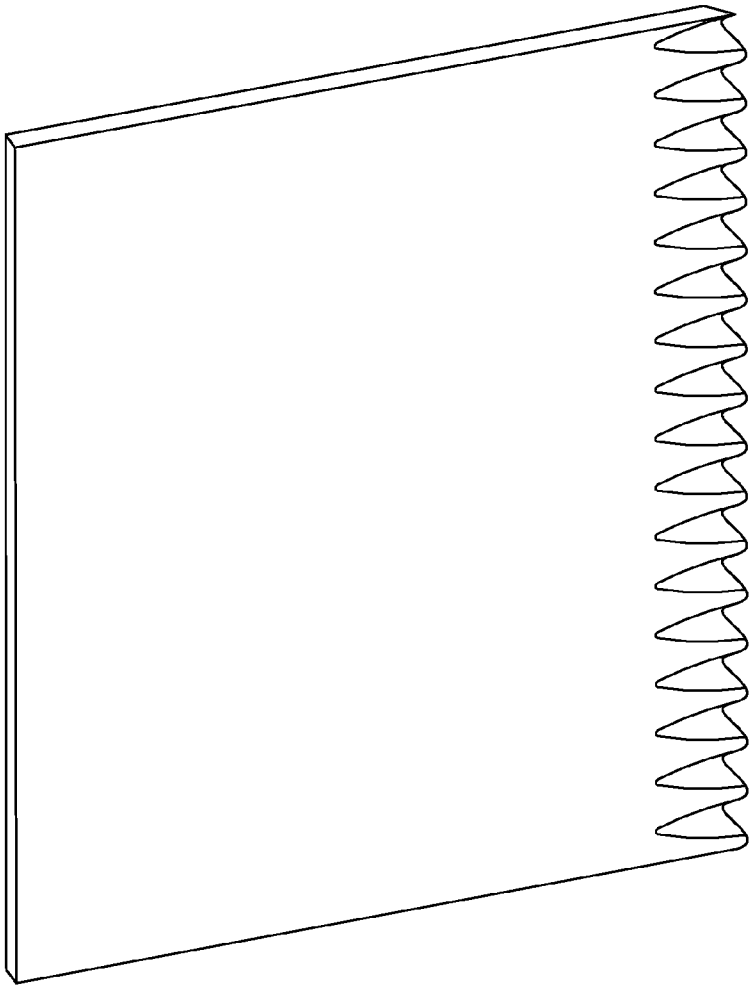
FIG. 17 illustrates a block diagram of a baffle having a waffled edge, in accordance with various example embodiments.
Figure 18:
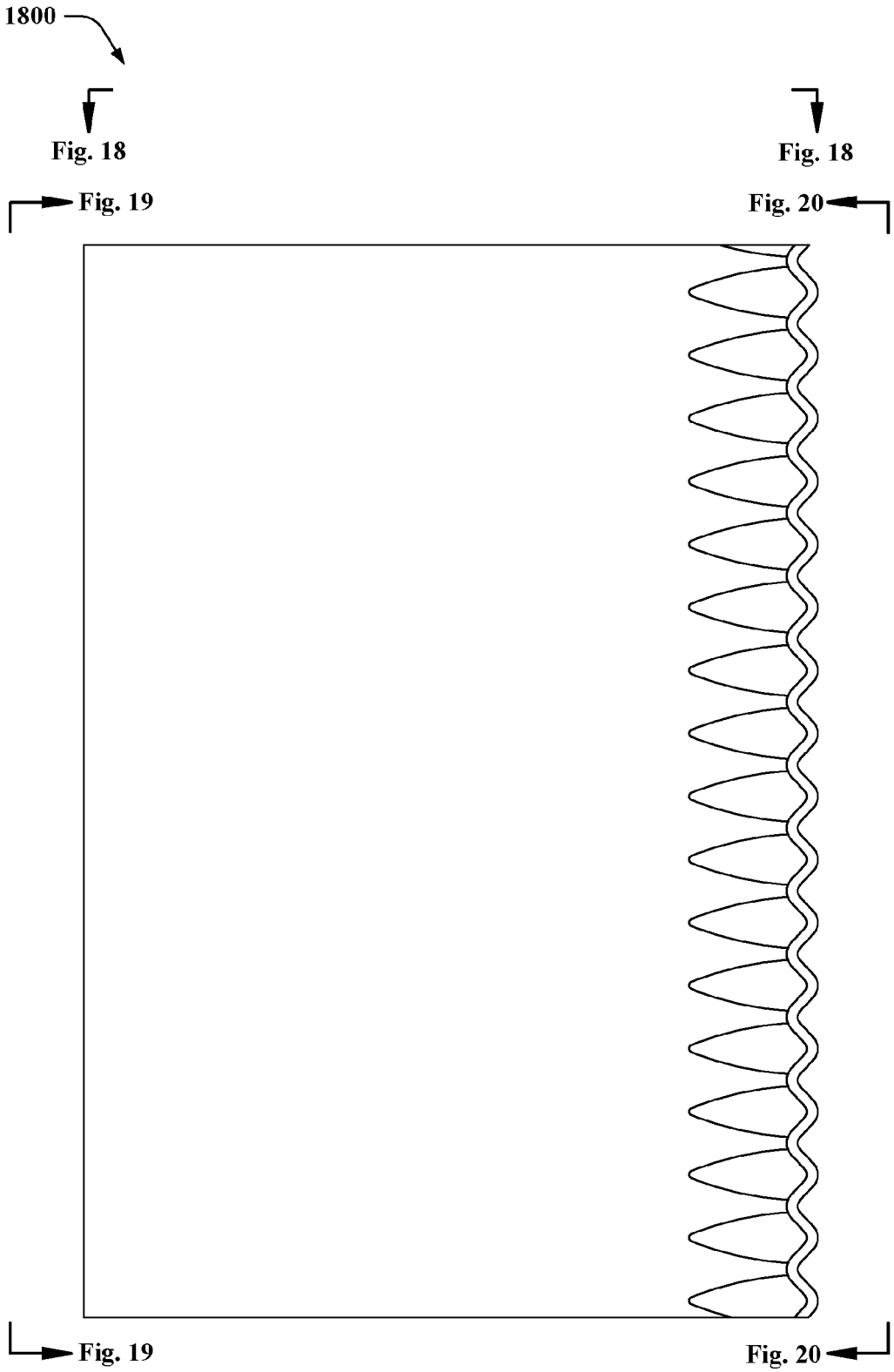
FIG. 18 illustrates a block diagram of a top view of a baffle having a waffled edge, in accordance with various example embodiments.
Figure 19:
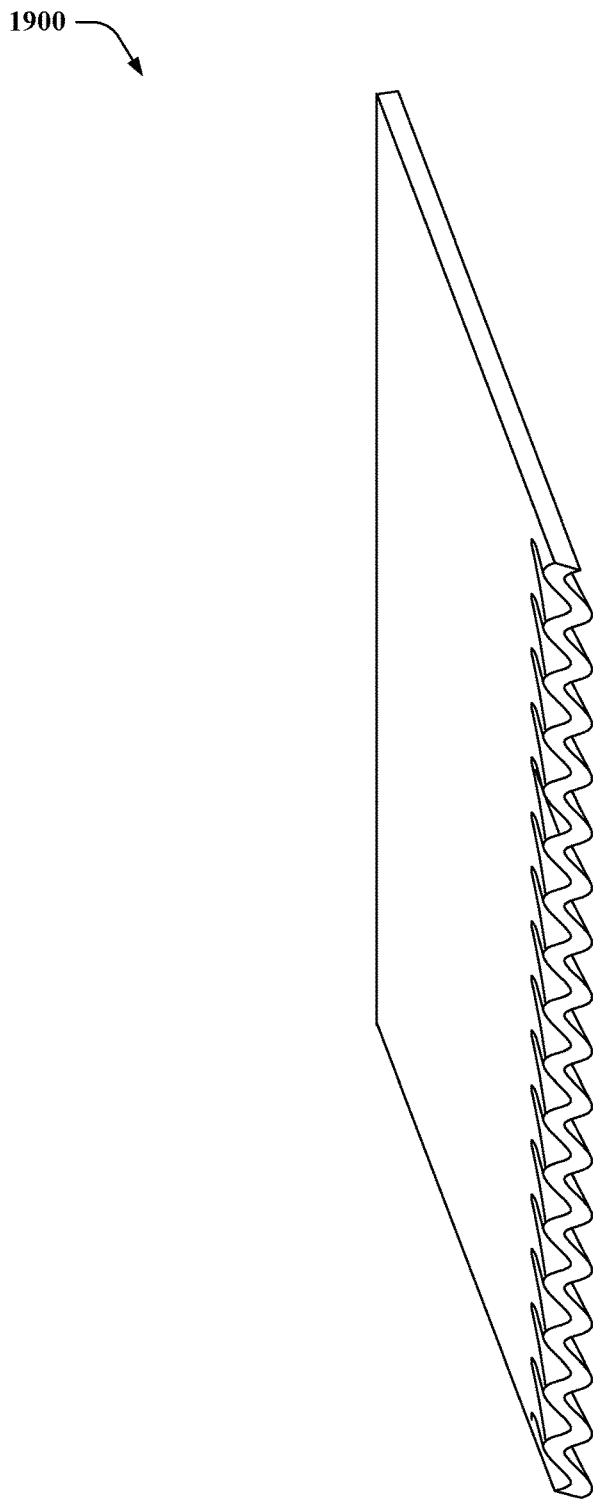
FIG. 19 illustrates another block diagram of a baffle having a waffled edge, in accordance with various example embodiments.
Figure 20:
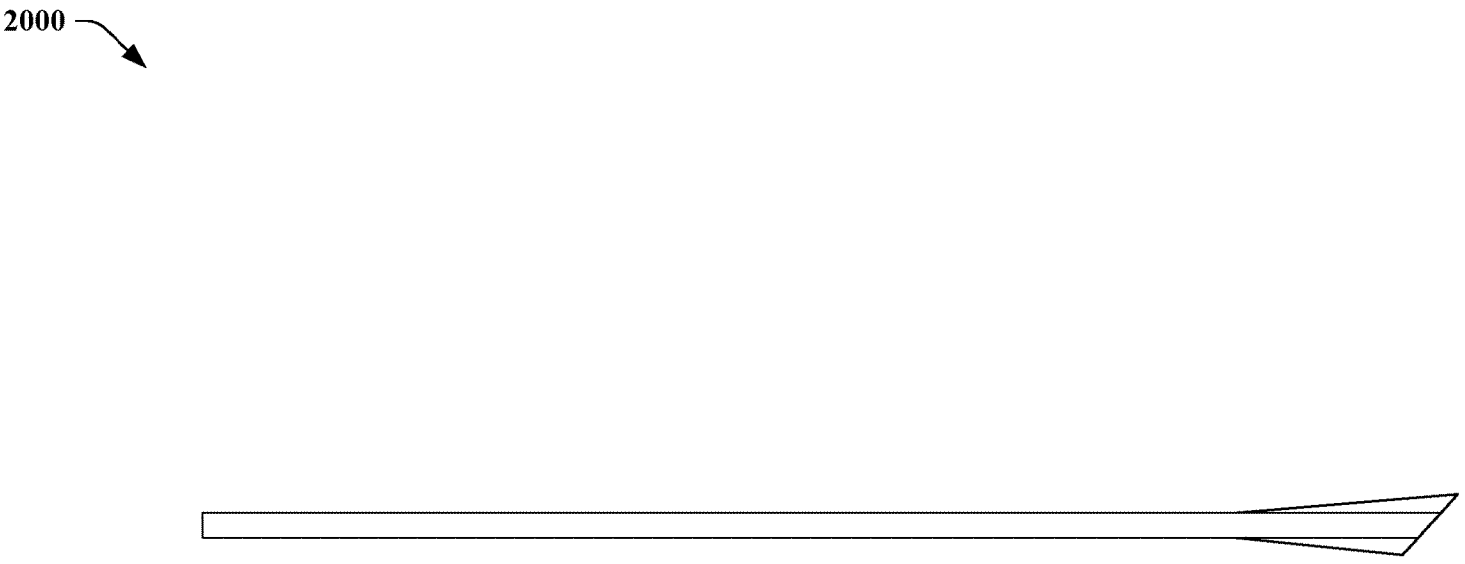
FIG. 20 illustrates a block diagram of a side view of a baffle having a waffled edge, in accordance with various example embodiments.
Figure 21:
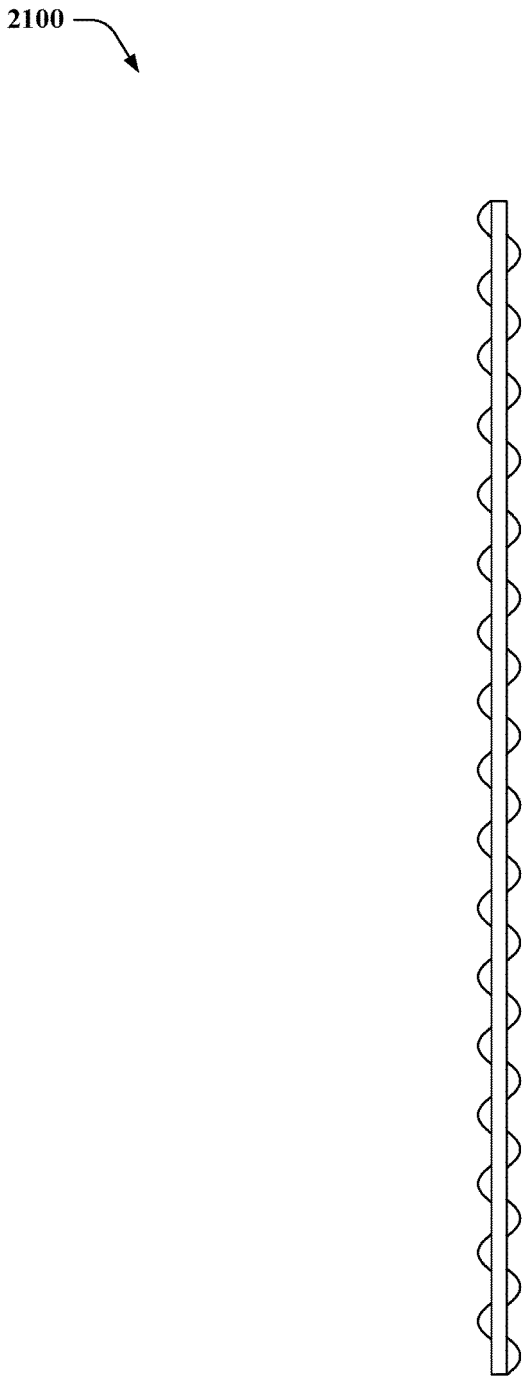
FIG. 21 illustrates a block diagram of a view of a baffle from an edge opposite from a waffled edge of the baffle, in accordance with various example embodiments.
Figure 22:
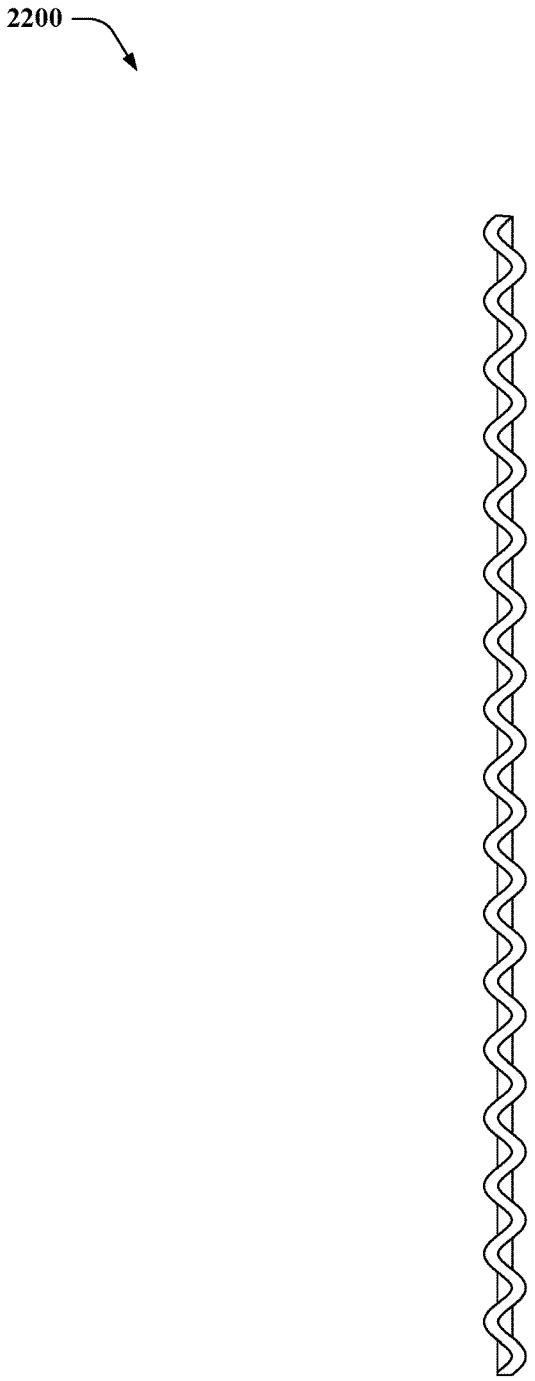
FIG. 22 illustrates a block diagram of a view of a baffle from a waffled edge of the baffle, in accordance with various example embodiments.

Referring now to FIGS. 13-16, block diagrams of different configurations and arrangements of slot antenna 100 are illustrated, in accordance with various example embodiments. As illustrated by FIG. 13, embodiments of slot antennas described herein (e.g. 100) can comprise, alternatively comprise, etc. rear-fed single element feed element 1310. FIG. 14 illustrates that embodiments of slot antennas described herein (e.g. 100) can comprise, alternatively comprise, etc. pair of rear-fed multi-element feed elements 1410. FIG. 15 illustrates that embodiments of slot antennas described herein (e.g. 100) can be arranged, configured, etc. in a stacked, multiphase array, e.g., for increasing signal gain. FIG. 16 illustrates that embodiments of slot antennas described herein (e.g. 100) can be configured, e.g., increased in height, to detect an electromagnetic signal, radio wave, etc. of increased frequency.

Figure 23:
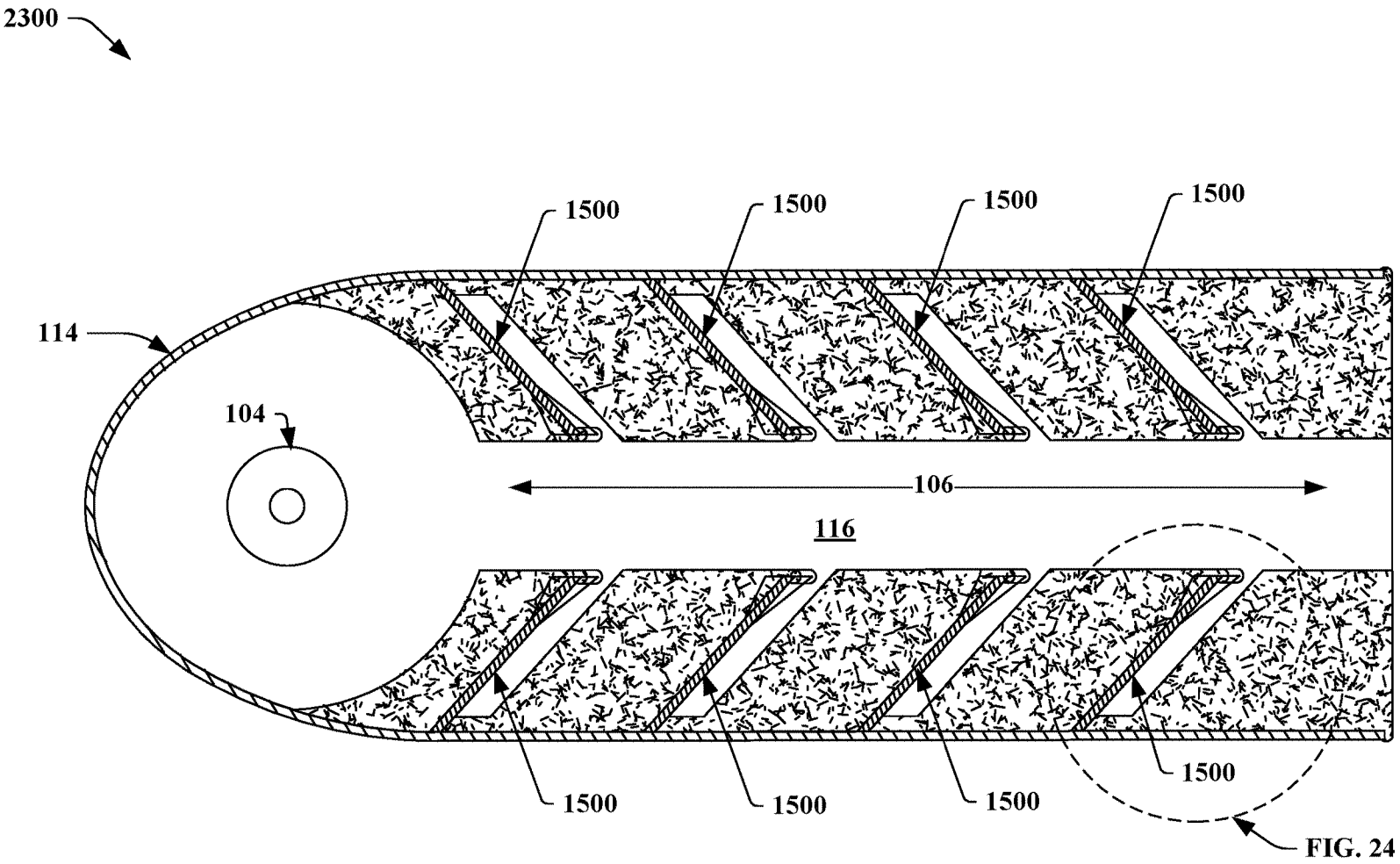
FIG. 23 illustrates a block diagram of a top view of a slot antenna comprising baffles having a waffled edge, in accordance with various example embodiments.
Figure 24:
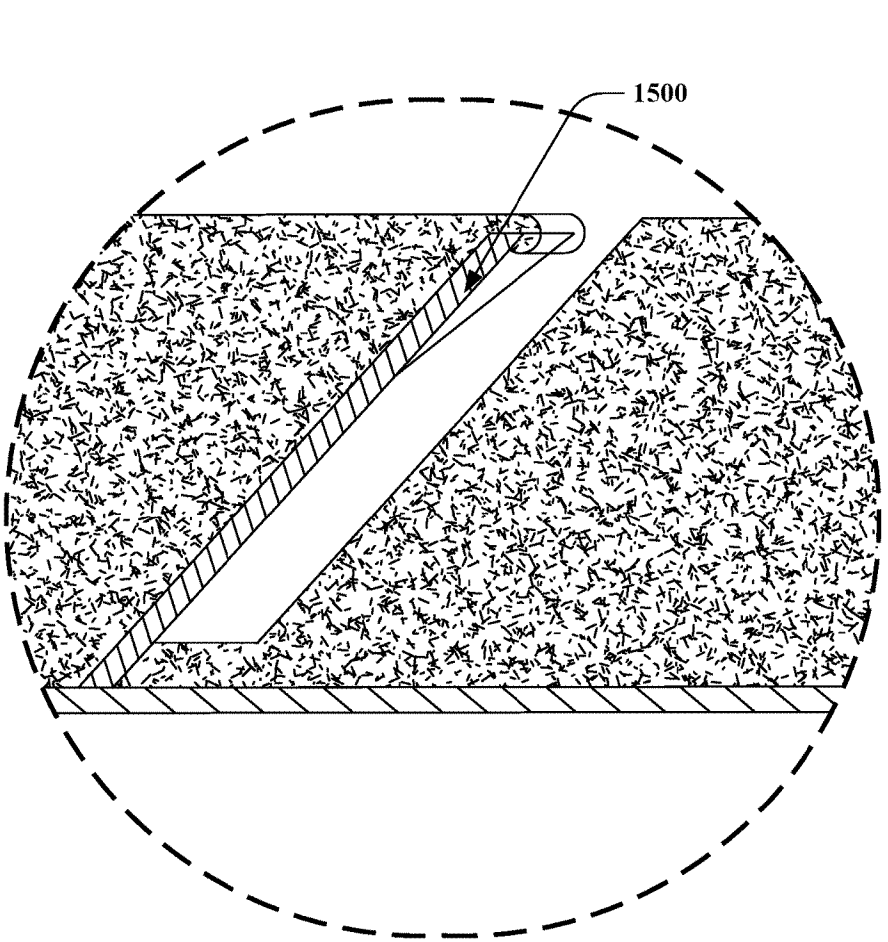
FIG. 24 illustrates a block diagram of a portion of a top view of a slot antenna comprising baffles having a waffled edge, in accordance with various example embodiments.

FIGS. 17-22 illustrate block diagrams of a baffle (e.g. 112) having a waffled edge, in accordance with various example embodiments. As illustrated by FIGS. 17-22, a waffled edge of baffle 112 can comprise a pattern of a change in direction along a top portion of the waffled edge, and along a side portion of the waffled edge. In this regard, and now referring to FIGS. 23-24, diagrams of a slot antenna (e.g. 100) comprising baffles (1500) having a waffled edge are illustrated, in accordance with various example embodiments. As illustrated by FIG. 24, exposed waffled edges of baffles 1500 can be surrounded, wrapped, etc. with RF absorbent material (e.g. 108), e.g., to reduce knife-edge refraction from such edges.

Figure 25:
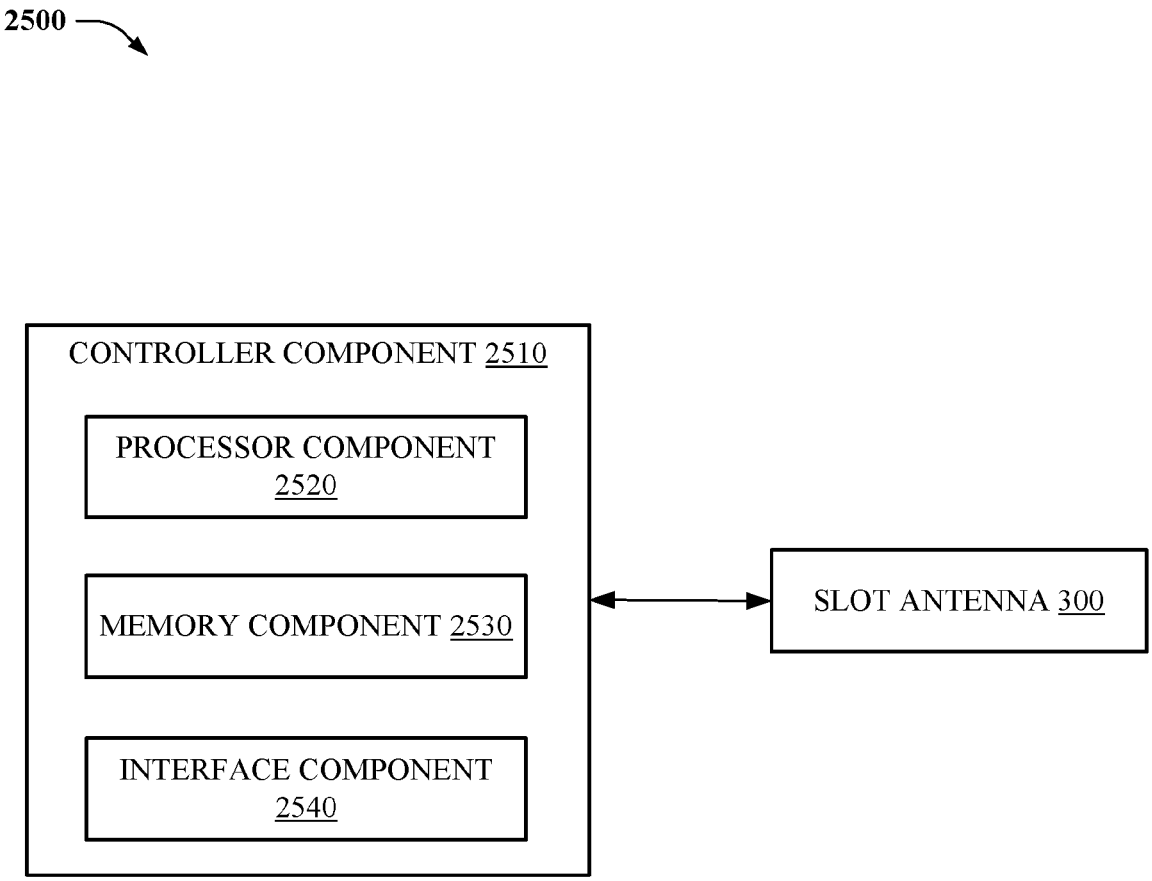
FIG. 25 illustrates a block diagram of a system comprising a controller component for receiving, transmitting, and processing respective electromagnetic signals via a slot antenna, in accordance with various example embodiments disclosed herein.

FIG. 25 illustrates a block diagram of a system (2500) comprising controller component 2510 for receiving, transmitting, and processing respective electromagnetic signals via a slot antenna (100, 300, etc.), in accordance with various example embodiments. Interface component 2540 comprises an electrical interface coupled between processing component 2510 and/or memory component 2520 and the slot antenna for enabling processing component 2510 to perform various operations related to receiving, transmitting, and processing respective electromagnetic signals via the slot antenna. In this regard, it should be appreciated by a person of ordinary skill in the art of antenna technologies having the benefit of the instant disclosure that interface component 2540 can enable transmission, reception, and processing of linearly polarized electromagnetic signals, elliptically polarized electromagnetic signals, circularly polarized electromagnetic signals, etc. utilizing slot antennas disclosed herein.

In embodiment(s), processing component 2510 can execute computer-readable instructions that facilitate performance of operations—utilizing slot antennas disclosed herein—related to identifying signal sources that are negatively impacting a wireless communication environment, and/or related to improving wireless coverage in wireless environments corresponding to narrow wireless coverage areas.

In this regard, such operations can comprise receiving, via a central chamber (106, 306, etc.) between columns of segments of a slot antenna, a first electromagnetic signal away from a direct path from a source of the first electromagnetic signal to an electrical element of the slot antenna—the segments being adjacent to respective baffles and comprising a radio frequency absorbent material, and the first electromagnetic signal being absorbed in a segment of the segments.

In one embodiment, a column of the columns comprises a side chamber between a pair of the segments, and a baffle of the respective baffles is adjacent to a first segment of the pair of segments. Further, the first electromagnetic signal can be reflected from the baffle to a second segment of the pair of segment, and absorbed in the second segment.

In another embodiment, an aperture size of the aperture, a size of the electrical element, a position of the electrical element, an angle of the baffle, and/or a length of the baffle is configurable to optimize a reception characteristic of the slot antenna and/or a transmission characteristic of the slot antenna. In yet another embodiment, the aperture size can be opened up, e.g., made larger, to enable a wider beam of an electromagnetic signal to be received within the central chamber. In one embodiment, a length of the central chamber, or channel, can be shortened, and some of the respective baffles can be removed for beam widening, e.g., to enable the wider beam of the electromagnetic signal to be received within the central chamber.

Further, the operations can comprise: receiving, via the central chamber, a second electromagnetic signal along the direct path from the source to the electrical element; and determining, via the electrical element based on the reception characteristic of the slot antenna, an electrical characteristic of the second electromagnetic signal.

In another embodiment, the operations can comprise: transmitting, from the electrical element via the central chamber, a second electromagnetic signal along the direct path to a destination device based on the transmission characteristic of the slot antenna.

Figure 26:
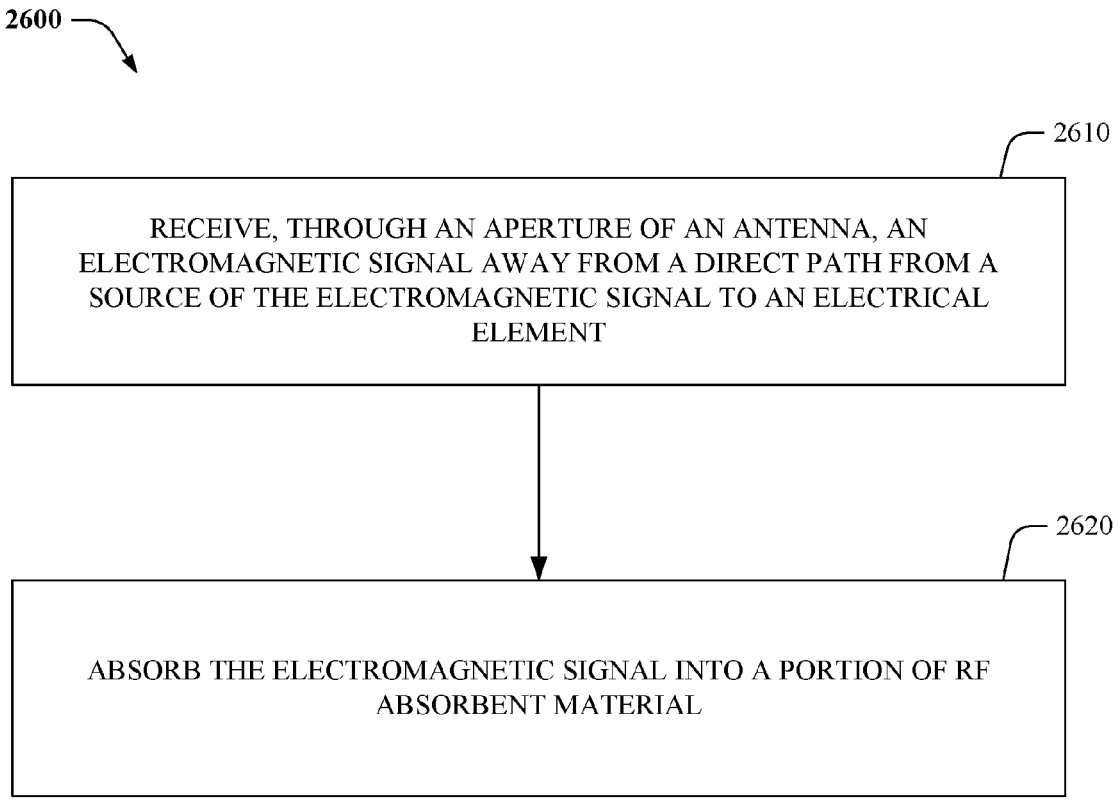
FIG. 26 illustrates a block diagram of a method associated with a slot antenna, in accordance with various example embodiments.
Figure 27:
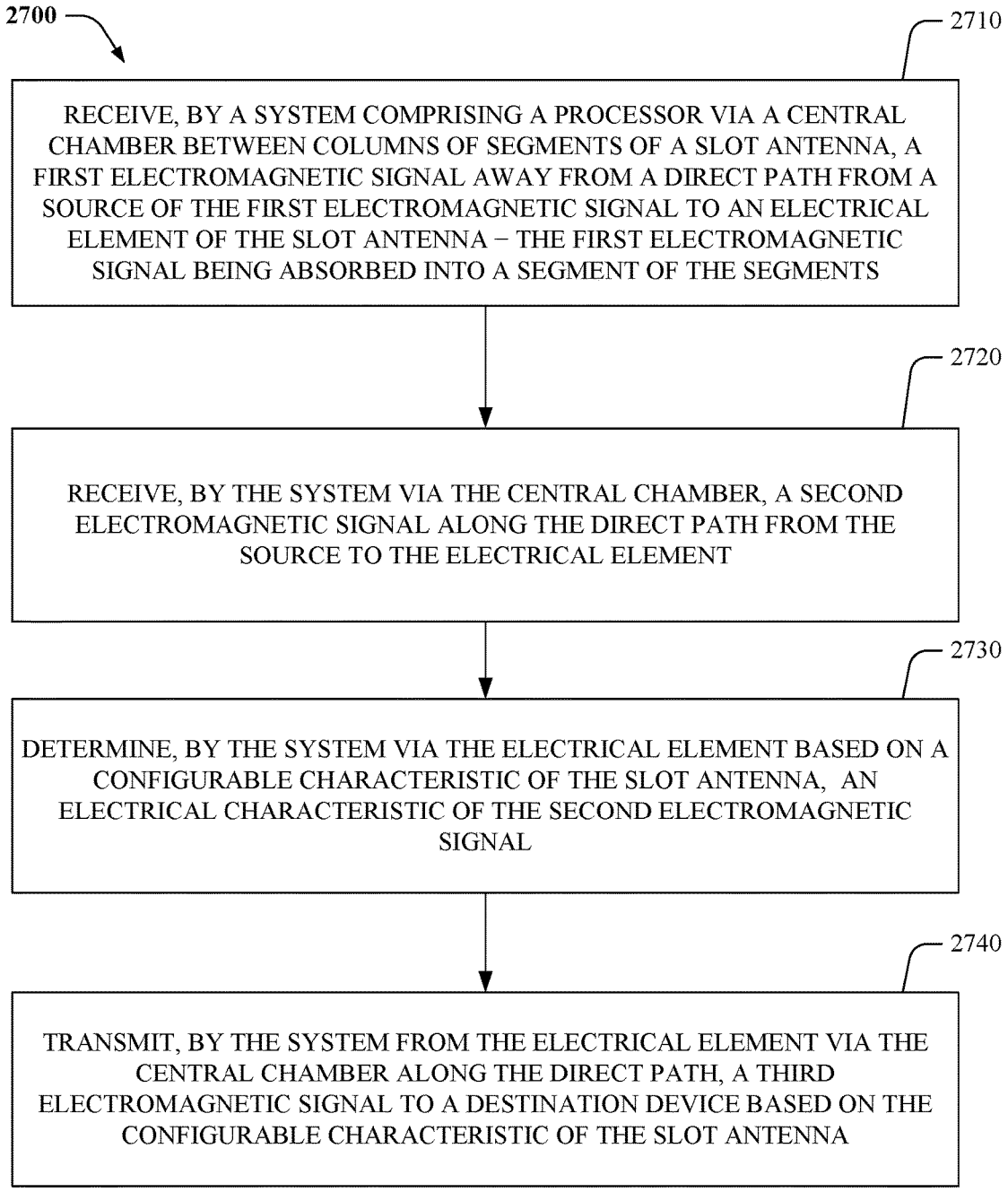
FIG. 27 illustrates a block diagram of a method associated with a system comprising a slot antenna, in accordance with various example embodiments.

FIGS. 26-27 illustrate methodologies in accordance with the disclosed subject matter. For simplicity of explanation, the methodologies are depicted and described as a series of acts. It is to be understood and appreciated that the subject innovation is not limited by the acts illustrated and/or by the order of acts. For example, acts can occur in various orders and/or concurrently, and with other acts not presented or described herein. Furthermore, not all illustrated acts may be required to implement the methodologies in accordance with the disclosed subject matter. In addition, those skilled in the art will understand and appreciate that the methodologies could alternatively be represented as a series of interrelated states via a state diagram or events. Additionally, it should be further appreciated that some of the methodologies disclosed hereinafter and throughout this specification (e.g. process 2700 associated with system 2500) are capable of being stored on an article of manufacture to facilitate transporting and transferring such methodologies to computers. The term article of manufacture, as used herein, is intended to encompass a computer program accessible from any computer-readable device, carrier, or media.

Referring now to FIG. 26, a process (2600) corresponding a slot antenna (100, 300, etc.) is illustrated, in accordance with various example embodiments. At 2610, an electromagnetic signal can be received, through an aperture of the slot antenna corresponding to a first opening of a central chamber included between portions of RF absorbent material, e.g., foam, away from a direct path from a source of the electromagnetic signal to an electrical element, e.g., monopole, dipole, etc. corresponding to a second opening of the central chamber.

At 2620, the electromagnetic signal can be absorbed into, within, etc. a first portions of the portions of RF absorbent material. In this regard, the first portion can comprise a baffle that is adjacent to a first segment of RF absorbent material, the baffle can comprise a metallic element, e.g., conductor, which alters an RF propagation of the electromagnetic signal from the central chamber into the RF absorbent material.

FIG. 27 illustrates a process (2700) performed by a system (2500) comprising a slot antenna, in accordance with various example embodiments. At 2710, a first electromagnetic signal can be received, via a central chamber between columns of segments of a slot antenna, away from a direct path from a source of the first electromagnetic signal to an electrical element of the slot antenna—the first electromagnetic signal being absorbed into a segment of the segments.

At 2720, a second electromagnetic signal can be received, via the central chamber, along the direct path from the source to the electrical element. At 2730, an electrical characteristic of the second electromagnetic signal can be determined, via the electrical element, based on a configurable characteristic of the slot antenna.

At 2740, a third electromagnetic signal can be transmitted, via the central chamber from the electrical element along the direct path, to a destination device based on the configurable characteristic of the slot antenna.

As it employed in the subject specification, the term "processor" can refer to substantially any computing processing unit or device comprising, but not limited to comprising, single-core processors; single-processors with software multithread execution capability; multi-core processors; multi-core processors with software multithread execution capability; multi-core processors with hardware multithread technology; parallel platforms; and parallel platforms with distributed shared memory. Additionally, a processor can refer to an integrated circuit, an application specific integrated circuit (ASIC), a digital signal processor (DSP), a field programmable gate array (FPGA), a programmable logic controller (PLC), a complex programmable logic device (CPLD), a discrete gate or transistor logic, discrete hardware components, or any combination thereof designed to perform the functions and/or processes described herein. Processors can exploit nano-scale architectures such as, but not limited to, molecular and quantum-dot based transistors, switches and gates, in order to optimize space usage or enhance performance of mobile devices. A processor may also be implemented as a combination of computing processing units.

In the subject specification, terms such as "memory component", and substantially any other information storage component relevant to operation and functionality of a component and/or process, refer to "memory components," or entities embodied in a "memory," or components comprising the memory. It will be appreciated that the memory components described herein can be either volatile memory or nonvolatile memory, or can include both volatile and nonvolatile memory.

By way of illustration, and not limitation, nonvolatile memory, for example, can be included in memory component 2530. Further, nonvolatile memory can be included in read only memory (ROM), programmable ROM (PROM), electrically programmable ROM (EPROM), electrically erasable ROM (EEPROM), or flash memory. Volatile memory can include random access memory (RAM), which acts as external cache memory. By way of illustration and not limitation, RAM is available in many forms such as synchronous RAM (SRAM), dynamic RAM (DRAM), synchronous DRAM (SDRAM), double data rate SDRAM (DDR SDRAM), enhanced SDRAM (ESDRAM), Synchlink DRAM (SLDRAM), and direct Rambus RAM (DRRAM). Additionally, the disclosed memory components of systems or methods herein are intended to comprise, without being limited to comprising, these and any other suitable types of memory.

Furthermore, to the extent that the terms "includes," "has," "contains," and other similar words are used in either the detailed description or the appended claims, such terms are intended to be inclusive—in a manner similar to the term "comprising" as an open transition word—without precluding any additional or other elements. Moreover, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Furthermore, the word "exemplary" and/or "demonstrative" is used herein to mean serving as an example, instance, or illustration. For the avoidance of doubt, the subject matter disclosed herein is not limited by such examples. In addition, any aspect or design described herein as "exemplary" and/or "demonstrative" is not necessarily to be construed as preferred or advantageous over other aspects or designs, nor is it meant to preclude equivalent exemplary structures and techniques known to those of ordinary skill in the art.

The above description of illustrated embodiments of the subject disclosure, including what is described in the Abstract, is not intended to be exhaustive or to limit the disclosed embodiments to the precise forms disclosed. While specific embodiments and examples are described herein for illustrative purposes, various modifications are possible that are considered within the scope of such embodiments and examples, as those skilled in the relevant art can recognize.

In this regard, while the disclosed subject matter has been described in connection with various embodiments and corresponding Figures, where applicable, it is to be understood that other similar embodiments can be used or modifications and additions can be made to the described embodiments for performing the same, similar, alternative, or substitute function of the disclosed subject matter without deviating therefrom. Therefore, the disclosed subject matter should not be limited to any single embodiment described herein, but rather should be construed in breadth and scope in accordance with the appended claims below.

What is claimed is:

1. A method, comprising:

receiving, via an aperture of an antenna, a first electromagnetic signal, the receiving occurring away from a direct path from a source of the first electromagnetic signal to an electrical element of the antenna, wherein the aperture corresponds to a first opening of a central chamber included between portions of radio frequency absorbent material, and wherein the electrical element corresponds to a second opening of the central chamber; and absorbing the first electromagnetic signal by a first portion of the portions of radio frequency absorbent material of a wall of a side chamber between the first portion and a second portion of the portions of radio frequency material, wherein the second portion comprises a baffle that is across from the first portion and that comprises a metallic element that alters a radio frequency propagation of the first electromagnetic signal from the central chamber into the first portion of the portions of radio frequency absorbent material.

2. The method of claim 1, further comprising:

transmitting, via the aperture, a second electromagnetic signal from the electrical element.

3. The method of claim 1, wherein the absorbing comprises:

reflecting, via the side chamber between the first portion and the second portion, the first electromagnetic signal from the baffle to the first portion; and absorbing the first electromagnetic signal by the first portion.

4. The method of claim 1, further comprising:

receiving, via the aperture, a second electromagnetic signal away from the direct path from the source to the electrical element; and absorbing the second electromagnetic signal by the first portion.

5. The method of claim 1, further comprising:

receiving, via the aperture, a second electromagnetic signal away from the direct path from the source to the electrical element; and absorbing the second electromagnetic signal by the second portion.

6. The method of claim 1, further comprising:

receiving, via the aperture along the direct path from the source to the electrical element, a second electromagnetic signal at the electrical element.

7. The method of claim 6, wherein the electrical element comprises elements, and wherein the receiving comprises receiving, via the aperture along the direct path, the second electromagnetic signal at the elements.

8. The method of claim 7, wherein the elements comprise a monopole element.

9. The method of claim 7, wherein the elements comprise a dipole element.

10. An antenna, comprising:

an electrical element;

an aperture;

a center channel comprising a front portion corresponding to the aperture and a back portion corresponding to the electrical element; and columns of radio frequency absorbent material adjacent to respective sides of the center channel, wherein a column of the columns corresponds to a side channel between a first section of the radio frequency absorbent material and a second section of the radio frequency absorbent material, wherein the first section comprises a baffle comprising a metallic element that alters a radio frequency propagation of a first radio wave from the center channel into the second section, wherein the first radio wave has been received through the aperture and misaligned from a direct path between a source of the first radio wave and the electrical element, and wherein the second section absorbs the first radio wave.

11. The antenna of claim 10, wherein the electrical element is configured to transmit a second radio wave through the aperture along the direct path.

12. The antenna of claim 10, wherein the baffle reflects the first radio wave to the second section.

13. The antenna of claim 12, wherein a second radio wave has been received through the aperture and misaligned from the direct path between the source and the electrical element, and wherein the first section absorbs the second radio wave.

14. The antenna of claim 12, wherein a second radio wave has been received through the aperture and misaligned from the direct path between the source and the electrical element, and wherein the second section absorbs the second radio wave.

15. The antenna of claim 12, wherein a second radio wave has been received through the aperture and misaligned from the direct path between the source and the electrical element, and wherein a third section of the radio frequency absorbent material absorbs the second radio wave.

16. The antenna of claim 10, wherein the electrical element receives, through the aperture along the direct path between the source and the electrical element, a second radio wave.

17. The antenna of claim 10, wherein a size of the aperture is configurable.

18. A system, comprising:

a processor; and a memory that stores executable instructions that, when executed by the processor, facilitate performance of operations, comprising:

receiving, via a central chamber between columns of segments of an antenna, a first electromagnetic signal outside of a direct path from a source of the first electromagnetic signal to an electrical element of the antenna, wherein the segments comprise a radio frequency absorbent material; and absorbing the first electromagnetic signal by a segment of the segments that is adjacent to a baffle that alters a radio frequency propagation of the first electromagnetic signal.

19. The system of claim 18, wherein a column of the columns comprises a side chamber between a pair of the segments, and wherein the absorbing comprises:

reflecting the first electromagnetic signal from the baffle to the segment.

20. The system of claim 18, wherein at least one of a size of the electrical element, a position of the electrical element, an angle of the baffle, or a length of the baffle is configurable to modify at least one of a reception characteristic of the antenna or a transmission characteristic of the antenna, and wherein the operations further comprise:

receiving, via the central chamber, a second electromagnetic signal along the direct path from the source to the electrical element; and determining, via the electrical element based on the reception characteristic or the transmission characteristic, an electrical characteristic of the second electromagnetic signal.

* * * * *